US009230734B2

(12) United States Patent
Sugihara et al.

(10) Patent No.: US 9,230,734 B2
(45) Date of Patent: Jan. 5, 2016

(54) U-SHAPED IRON CORE TRANSPORTING/ASSEMBLING TANK

(71) Applicant: KABUSHIKI KAISHA TOSHIBA, Tokyo (JP)

(72) Inventors: Masaki Sugihara, Kanagawa (JP); Keigo Shibata, Kanagawa (JP); Shin Yamada, Tokyo (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 252 days.

(21) Appl. No.: 13/965,868

(22) Filed: Aug. 13, 2013

(65) Prior Publication Data

US 2013/0326869 A1 Dec. 12, 2013

Related U.S. Application Data

(60) Division of application No. 12/711,669, filed on Feb. 24, 2010, now Pat. No. 8,528,191, which is a continuation-in-part of application No. PCT/JP2008/002180, filed on Aug. 8, 2008.

(30) Foreign Application Priority Data

Aug. 27, 2007 (JP) ..... 2007-220023
Oct. 29, 2007 (JP) ..... 2007-279911

(51) Int. Cl.

| | |
|---|---|
| ***H01F 41/02*** | (2006.01) |
| ***H01F 27/26*** | (2006.01) |
| *H01F 27/00* | (2006.01) |
| *H01F 27/245* | (2006.01) |

(52) U.S. Cl.

CPC ..... *H01F 41/0206* (2013.01); *H01F 27/263* (2013.01); *H01F 41/02* (2013.01); *H01F 27/002* (2013.01); *H01F 27/245* (2013.01); *Y10T 29/4902* (2015.01); *Y10T 29/49075* (2015.01); *Y10T 29/49078* (2015.01); *Y10T 29/49819* (2015.01); *Y10T 29/5313* (2015.01); *Y10T 29/53165* (2015.01); *Y10T 29/53265* (2015.01)

(58) Field of Classification Search

CPC ..... H01F 27/002; H01F 27/245; H01F 27/26; H01F 27/263; H01F 41/02; H01F 41/0206; Y10T 29/4902; Y10T 29/49075; Y10T 29/49078; Y10T 29/5313; Y10T 29/53165; Y10T 29/53265

See application file for complete search history.

(56) References Cited

U.S. PATENT DOCUMENTS

| | | | | |
|---|---|---|---|---|
| 3,740,684 | A * | 6/1973 | Niederjohn et al. | H01F 27/002 |
| 2007/0247266 | A1* | 10/2007 | Yargole et al. | H01F 41/245 |
| 2010/0154202 | A1 | 6/2010 | Shibata et al. | |

FOREIGN PATENT DOCUMENTS

| | | | |
|---|---|---|---|
| JP | 47-23848 | Y1 | 7/1972 |
| JP | 59-16118 | U | 1/1984 |
| JP | 1-145112 | U | 10/1989 |

(Continued)

*Primary Examiner* — A. Dexter Tugbang
(74) *Attorney, Agent, or Firm* — Foley & Lardner LLP

(57) ABSTRACT

A U-shaped iron core transporting/assembling tank is divided into a first leg iron core tank for housing a first leg iron core, a second leg iron core tank for housing a second leg iron core, and a lower-yoke iron core assembling tank. The first and second leg iron core tanks are integrated to constitute an erection tank. The lower-yoke iron core assembling tank has an opening portion for opening or closing which is formed in one longitudinal side surface of the lower-yoke iron core and through which the lower-yoke iron core can be carried in or out. The lower-yoke iron core assembling tank is connected at the opening portion which is opened when the lower-yoke iron core is housed in the lower-yoke iron core assembling tank.

10 Claims, 17 Drawing Sheets

(56) References Cited

FOREIGN PATENT DOCUMENTS

| | | | | |
|---|---|---|---|---|
| JP | 04-186808 | A | | 7/1992 |
| JP | 2001-257119 | A | | 9/2001 |
| JP | 2003-224016 | A | | 8/2003 |
| JP | 2007-067112 | A | | 3/2007 |
| JP | 2007067112 | A | * | 3/2007 |
| JP | 2008-147545 | A | | 6/2008 |
| JP | 2008-252028 | A | | 10/2008 |

* cited by examiner

U-SHAPED IRON CORE TRANSPORTING/ASSEMBLING TANK

CROSS REFERENCES TO RELATED APPLICATIONS

This application is a divisional of U.S. application Ser. No. 12/711,669, filed on Feb. 24, 2010, now U.S. Pat. No. 8,528,191, which is a continuation-in-part (CIP) application based upon the International Application PCT/JP2008/002180, the International Filing Date of which is Aug. 8, 2008, the entire content of which are incorporated herein by reference, and claims the benefit of priority from the prior Japanese Patent Application No. 2007-220023, filed on Aug. 27, 2007, and the prior Japanese Patent Application No. 2007-279911, filed on Oct. 29, 2007, the entire contents of which are incorporated herein by references.

BACKGROUND OF THE INVENTION

The present invention relates to a U-shaped iron core transporting/assembling method in a transformer transported in a disassembled condition and a U-shaped iron core transporting/assembling tank used in the method.

In recent years, voltage to be supplied to a transmission system increases with an increase in electric power demand. Accordingly, the capacity, size, and weight of stationary induction electric appliances, such as transformers, used for power transmission/transformation increase.

Transformer stations in which a transformer is installed are often located in sites with severe transport conditions, such as mountain area or underground of urban areas. Therefore, it is necessary to significantly reduce the transportation dimension and weight of the stationary induction electric appliance installed in such sites.

In such a case, a disassembled transportation method capable of significantly reducing the transportation scale and weight of a product to be transported has been adopted as a transportation method of the transformer. In this method, a large capacity three-phase transformer, etc. that has already been produced and tested in a factory is disassembled into several components: a U-shaped iron core, yokes, coils, and the like, then the components are housed in transportation tanks specially designed for the respective components to their installation site, and the respective components are reassembled in, e.g., a clean house built at the installation site. A transformer transported using the above disassembled transportation method is referred to as "disassembled transportation transformer".

Recently, as disclosed in Japanese Patent Application Laid-Open Publication No. 2007-67112, the entire content of which is incorporated herein by reference, the U-shaped iron core is disassembled further into smaller parts (e.g., leg iron core and lower-yoke iron core) in order to reduce the size of each component to be transported.

The clean house used for assembling the disassembled transportation transformer at its installation site generally has two rooms: an assembling room and a spare room and has a structure in which framed support column are surrounded by a panel unit constituted by a plurality of plate materials. Each room has a roof at the top. The roof is constituted by a framing material and a water-proof sheet and extensively attached to the framing so as to be opened and closed. A dehumidifier, a dust collector, and the like are provided in both the assembling room and spare room for controlling the humidity or dust amount in the rooms. In general, it takes about 20 days to build up the clean house.

The U-shaped iron core that has been divided into the leg iron core, lower-yoke iron core, and the like and transported to the installation site is carried in the spare room where dehumidification and dust removal have been accomplished and unpacked from a transportation tank, etc., and then carried into the assembling room where dehumidification and dust removal have been accomplished, by a tow truck, etc.

However, the on-site iron core assembling method of the disassembled transportation transformer has the following problems.

For example, an iron core of a large capacity three-phase five-leg transformer is constituted by four U-shaped iron cores. Thus, it is necessary to assemble the four U-shaped iron cores at the installation site after the assembling room of the clean house has been built up. In general, it takes about 7 days to complete the assembly of one U-shaped iron core. In the space of a conventional assembling room where the U-shaped iron core is assembled, it is possible to assemble at most two U-shaped iron cores simultaneously, in general. In this case, it takes about 14 to 17 days to complete the assembly of all the U-shaped iron cores. Thus, it takes more time to install the entire transformer than in the case of a general disassembled transportation transformer where the iron core is transported in the form of the U-shaped iron core by the time length required for assembling the U-shaped iron core at the installation site.

Further, the above work schedule is applicable to only a case where the weather is stable. For example, it is necessary to open the roof of the assembling room when the iron core is carried into the assembling room, so that the carry-in work cannot be performed in the case of rain, delaying the installation.

Further, carry-in of the leg iron core and yoke iron core and carry-out of an erection tank in which the U-shaped iron core is housed and erected need to be performed using a tow truck. Hoisting up/down of the iron core by a tow truck needs to be performed at both the assembling room and spare room. The tow truck is parked in the intermediate portion between the assembling room and spare room and, there, the hoisting up/down of the leg iron core and yoke iron core is performed in a state where the arm of the tow truck is extended in an inclined manner. Thus, a tow truck with large hoisting capacity is required. The rental fee, etc., of such a tow truck with large hoisting capacity is high, and there is no other way but to rent a tow truck whose per-unit time rental fee is high in order to assemble the U-shaped iron core, causing increase in cost.

Further, the carry-in of the leg iron core and yoke iron core often needs to be performed many times, and every time the carry-in work is performed, the roofs of the spare room and assembling room need to be opened. When the roofs are opened, a large volume of external air is introduced inside the spare room and assembling room, so that it is necessary to perform dehumidification and dust removal every time the roofs are opened, which may cause delay of the installation.

BRIEF SUMMARY OF THE INVENTION

The present invention has been made to solve the above problems, and an object thereof is to reduce the installation period and installation cost by performing on-site assembly of the U-shaped iron core of a transformer, etc. in a U-shaped iron core transporting/assembling tank in the case where the U-shaped iron core is transported in a disassembled condition.

In order to achieve the object described above, there is presented a U-shaped iron core transporting/assembling method according to the present invention which is a U-shaped iron core transporting/assembling method in which a U-shaped iron core of a transformer is disassembled into a first leg iron core, a second leg iron core, and a lower-yoke iron core for transportation and reassembled after the transportation, said method comprising: an in-factory iron core assembling step of assembling the U-shaped iron core in a manufacturing factory of the U-shaped iron core; a U-shaped iron core housing step of housing, after the in-factory iron core assembling step, the U-shaped iron core in a tank that can be divided into a first leg iron core tank and a second leg iron core tank each having an opening/closing opening portion; a lower-yoke iron core separating step of separating, after the U-shaped iron core housing step, the lower-yoke iron core from the first leg iron core and second leg iron core in a state where the positions of the first leg iron core and second leg iron core are fixed in the tank; a lower-yoke iron core transporting tank transferring step of transferring, after the lower-yoke iron core separating step, the lower-yoke iron core to a lower-yoke iron core transporting tank; a tank dividing step of dividing, after the lower-yoke iron core transporting tank transferring step, the tank into the first leg iron core tank and second leg iron core tank for individually housing the first leg iron core and second leg iron core; a transporting step of individually transporting in a sideways attitude, after the tank dividing step, the first leg iron core, second leg iron core, and lower-yoke iron core housed respectively in the first leg iron core tank, second leg iron core tank, and lower-yoke iron core transporting tank in a state where the opening portions of the first leg iron core tank and second leg iron core tank are closed; a lower-yoke iron core assembling tank transferring step of transferring, after the transporting step, the lower-yoke iron core to a lower-yoke iron core assembling tank having an opening portion; a tank connecting step of connecting, after the lower-yoke iron core assembling tank transferring step, the opening portions of the first leg iron core tank, second leg iron core tank, and lower-yoke iron core assembling tank with the opening portions of the first leg iron core tank and second leg iron core tank opened while maintaining the first leg iron core, second leg iron core, and lower-yoke iron core in a sideways attitude; an iron core connecting step of moving, after the tank connecting step, the lower-yoke iron core to the inside of the first leg iron core tank and second leg iron core tank and connecting the first leg iron core, second leg iron core, and lower-yoke iron core; a lower-yoke iron core assembling tank separating step of separating, after the iron core connecting step, the lower-yoke iron core assembling tank from the first leg iron core tank and second leg iron core tank while maintaining the connecting state between the first leg iron core tank and second leg iron core tank; a bottom plate fitting step of fitting, after the lower-yoke iron core assembling tank separating step, a bottom plate to the opening portions of the first leg iron core tank and second leg iron core tank generated by the separation of the lower-yoke iron core assembling tank therefrom so as to close the opening portions; and an erecting step of erecting, after the bottom plate fitting step of fitting, the first leg iron core tank and second leg iron core tank with that the bottom plate facing down.

There is also presented a U-shaped iron core transporting/assembling method in which a U-shaped iron core of a transformer is disassembled into a first leg iron core, a second leg iron core, and a lower-yoke iron core for transportation and reassembled after the transportation, said method comprising: an in-factory iron core assembling step of assembling the U-shaped iron core in a manufacturing factory of the U-shaped iron core; a U-shaped iron core housing step of housing, after the in-factory iron core assembling step, the U-shaped iron core in a tank that can be divided into a first leg iron core tank and a second leg iron core tank each having an opening/closing opening portion; a lower-yoke iron core separating step of separating, after the U-shaped iron core housing step, the lower-yoke iron core from the first leg iron core and second leg iron core in a state where the positions of the first leg iron core and second leg iron core are fixed in the tank; a lower-yoke iron core assembling tank transferring step of transferring, after the lower-yoke iron core separating step, the lower-yoke iron core to a lower-yoke iron core assembling tank; a tank dividing step of dividing, after the lower-yoke iron core assembling tank transferring step, the tank into the first leg iron core tank and second leg iron core tank for individually housing the first leg iron core and second leg iron core; a transporting step of individually transporting in a sideways attitude, after the tank dividing step, the first leg iron core, second leg iron core, and lower-yoke iron core housed respectively in the first leg iron core tank, second leg iron core tank, and lower-yoke iron core transporting tank in a state where the opening portions of the first leg iron core tank and second leg iron core tank are closed; a tank connecting step of connecting, after the transporting step, the opening portions of the first leg iron core tank, second leg iron core tank, and lower-yoke iron core assembling tank with the opening portions of the first leg iron core tank and second leg iron core tank opened while maintaining the first leg iron core, second leg iron core, and lower-yoke iron core in a sideways attitude; an iron core connecting step of moving, after the tank connecting step, the lower-yoke iron core to the inside of the first leg iron core tank and second leg iron core tank and connecting the first leg iron core, second leg iron core, and lower-yoke iron core; a lower-yoke iron core assembling tank separating step of separating, after the iron core connecting step, the lower-yoke iron core assembling tank from the first leg iron core tank and second leg iron core tank while maintaining the connecting state between the first leg iron core tank and second leg iron core tank; a bottom plate fitting step of fitting, after the lower-yoke iron core assembling tank separating step, a bottom plate to the opening portions of the first leg iron core tank and second leg iron core tank generated by the separation of the lower-yoke iron core assembling tank therefrom so as to close the opening portions; and an erecting step of erecting, after the bottom plate fitting step of fitting, the first leg iron core tank and second leg iron core tank with that the bottom plate facing down.

There is also presented a U-shaped iron core transporting/assembling tank which can be divided into at least a first leg iron core tank for housing a first leg iron core and transporting it to an installation site, a second leg iron core tank for housing a second leg iron core and transporting it to the installation site, and a lower-yoke iron core assembling tank, wherein the first leg iron core tank comprises: an opening/closing first longitudinal opening portion formed in one longitudinal side surface; and an opening/closing first short opening portion formed in the end surface perpendicular to the one longitudinal side surface, the second leg iron core tank comprises: an opening/closing second longitudinal opening portion formed in one longitudinal side surface; an opening/closing second short opening portion formed in the end surface perpendicular to the side surface in which the opening/closing second longitudinal opening portion is formed; and erection tank connecting means for connecting the second longitudinal opening portion which is opened in a state where the second leg iron core is housed in the second leg iron core tank and first longitudinal opening portion which is opened in a state where the first leg iron core is housed in the first leg iron core tank for integration of the first leg iron core tank and second leg iron core tank so as to constitute an erection tank such that the first short opening portion and second short opening portion are arranged in the same plane so as to become one opening portion to which a bottom plate can be fitted, and the lower-yoke iron core assembling tank comprises: an opening/closing third opening portion which is formed in one longitudinal side surface of the lower-yoke iron core and through which the lower-yoke iron core can be carried in/out; and lower-yoke iron core assembling tank connecting means for connecting the third opening portion which is opened in a state where the lower-yoke iron core is housed in the lower-yoke iron core assembling tank and opened first short opening portion and opened second short opening portion of the erection tank housing the first leg iron core and second leg iron core for integration of the erection tank and lower-yoke iron core assembling tank.

Advantages of the Invention

According to the present invention, in the case where the U-shaped iron core is transported in a disassembled condition, it is possible to reduce the installation period and installation cost by performing on-site assembly of the U-shaped iron core of a transformer, etc. in a U-shaped iron core transporting/assembling tank.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which.

DETAILED DESCRIPTION OF THE INVENTION

Now, embodiments of the working apparatus and working method according to the present invention will be described referring to the accompanying drawings. Throughout the drawings, the same or similar components are denoted respectively by the same reference symbols and will not be described repeatedly.

Embodiments of the present invention will be described below with reference to the accompanying drawings.

First Embodiment

Figure 1:
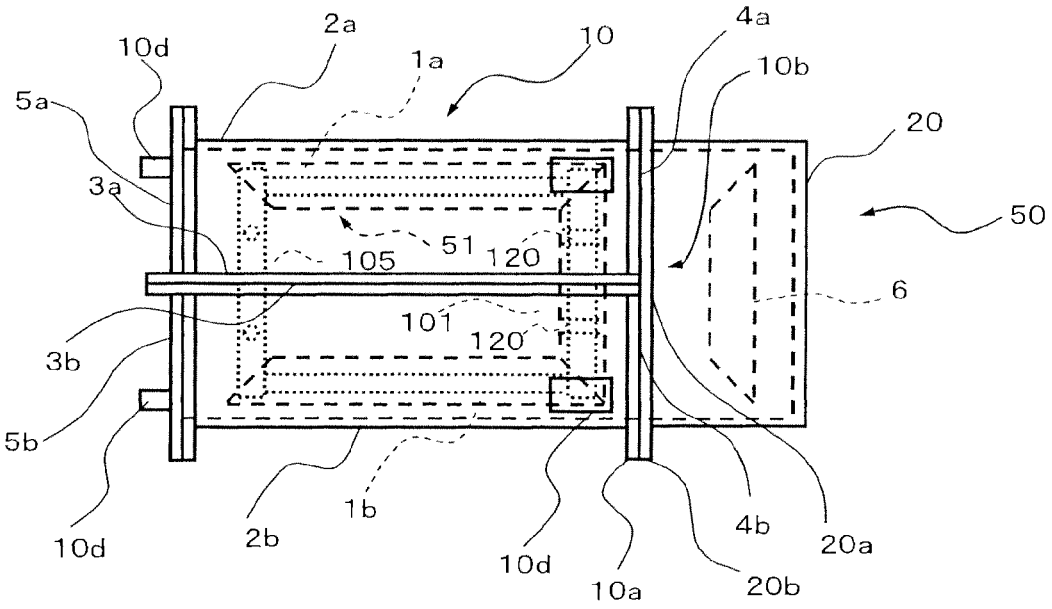
FIG. 1 shows a first embodiment of a U-shaped iron core transporting/assembling method, which is a schematic plan view showing a state where a U-shaped iron core is housed in a U-shaped iron core transporting/assembling tank.
Figure 2:
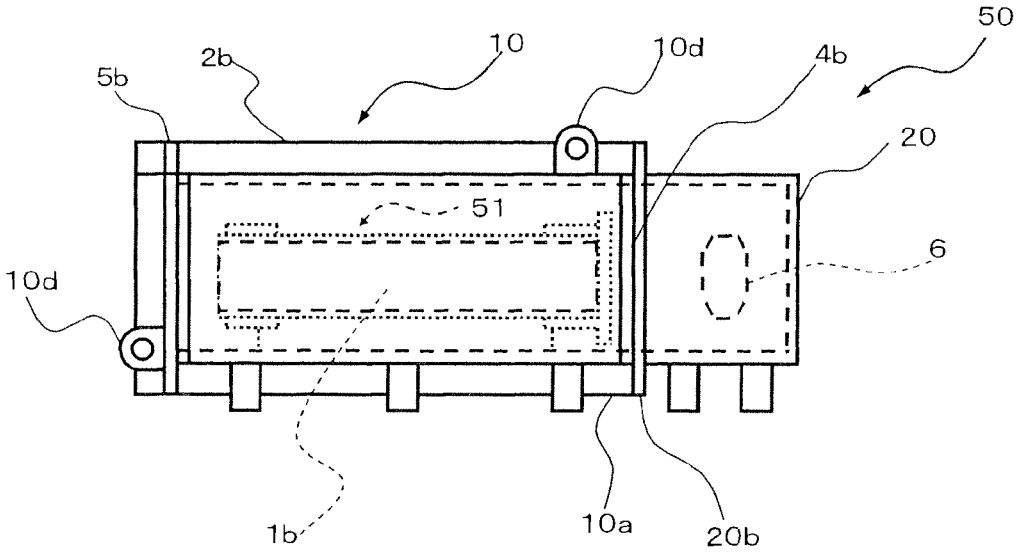
FIG. 2 is a schematic front view showing the U-shaped iron core transporting/assembling tank of FIG. 1.
Figure 3:
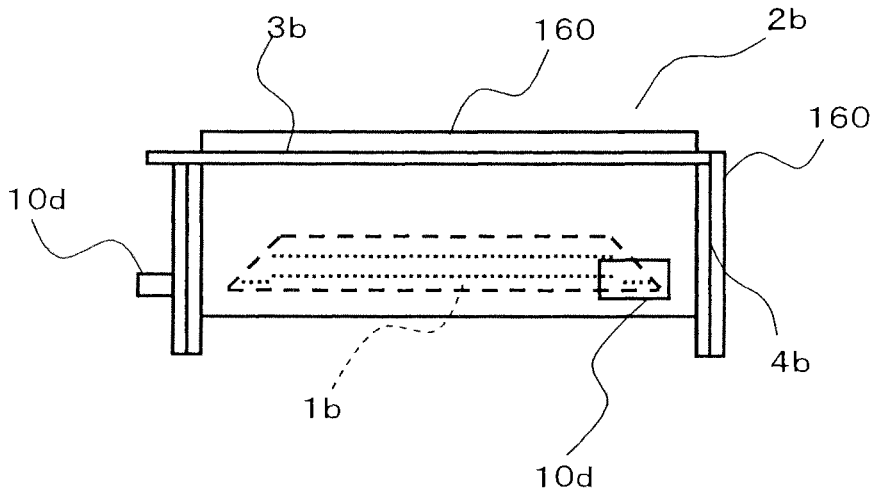
FIG. 3 is a schematic plan view showing a second leg iron core tank of FIG. 1 in a state of being transported.
Figure 4:
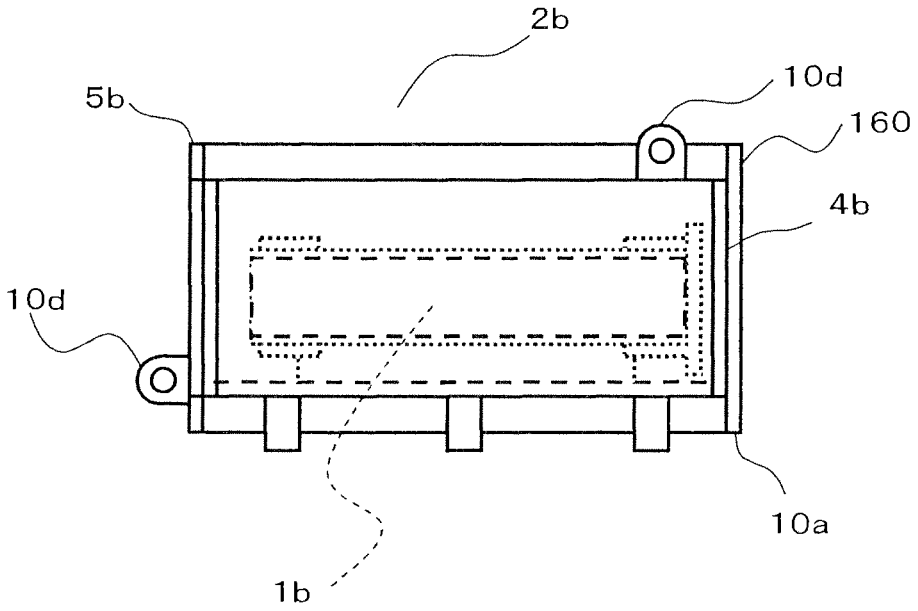
FIG. 4 is a schematic front view showing the second leg iron core tank of FIG. 3.
Figure 5:
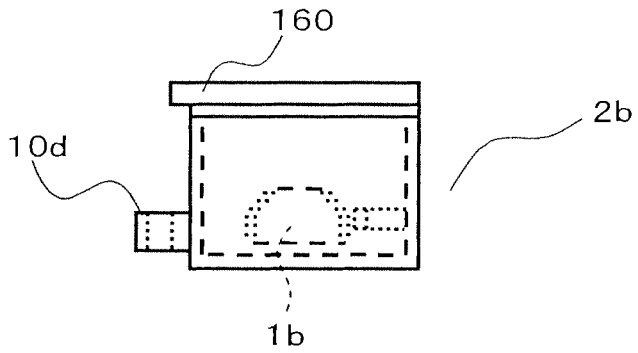
FIG. 5 is a schematic side view showing the second leg iron core tank of FIG. 3.

A first embodiment of a U-shaped iron core transporting/assembling method according to the present invention will be described with reference to FIGS. 1 to 7. FIG. 1 is a schematic plan view showing a state where a U-shaped iron core 51 is housed in a U-shaped iron core transporting/assembling tank 50 used in the present embodiment. FIG. 2 is a schematic front view showing the U-shaped iron core transporting/assembling tank 50 of FIG. 1. FIGS. 3 to 5 show a second leg iron core tank 2*b* in a state of being transported, wherein FIG. 3 is a schematic plan view, FIG. 4 is a schematic front view of FIG. 3, and FIG. 5 is a schematic side view of FIG. 3.

Figure 6:
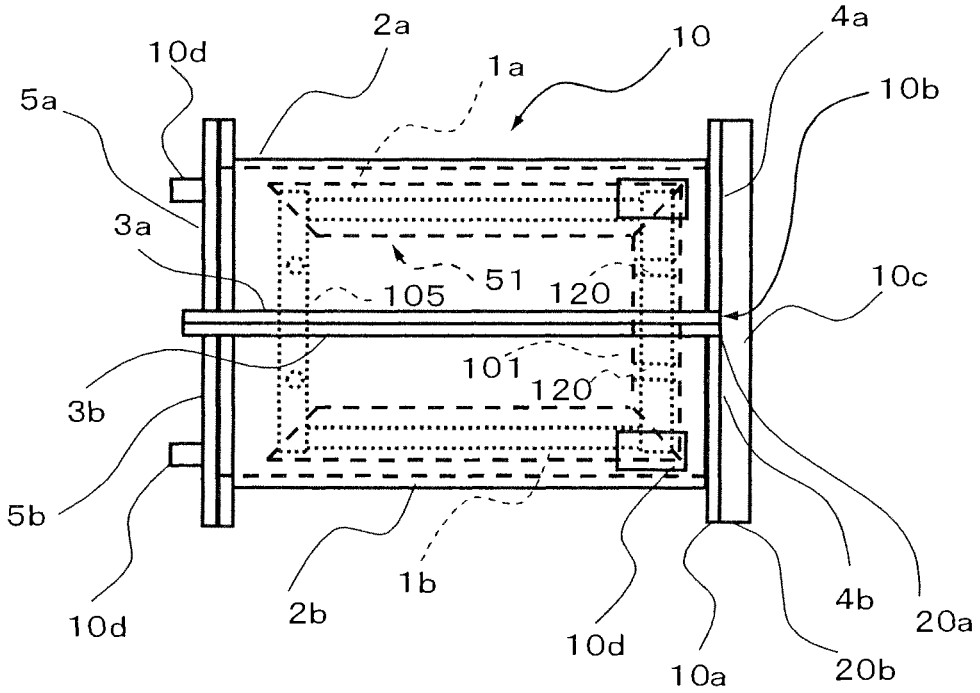
FIG. 6 is a schematic plan view showing a state where the U-shaped iron core is housed in an erection tank of FIG. 1 and a third opening portion is closed.
Figure 7:
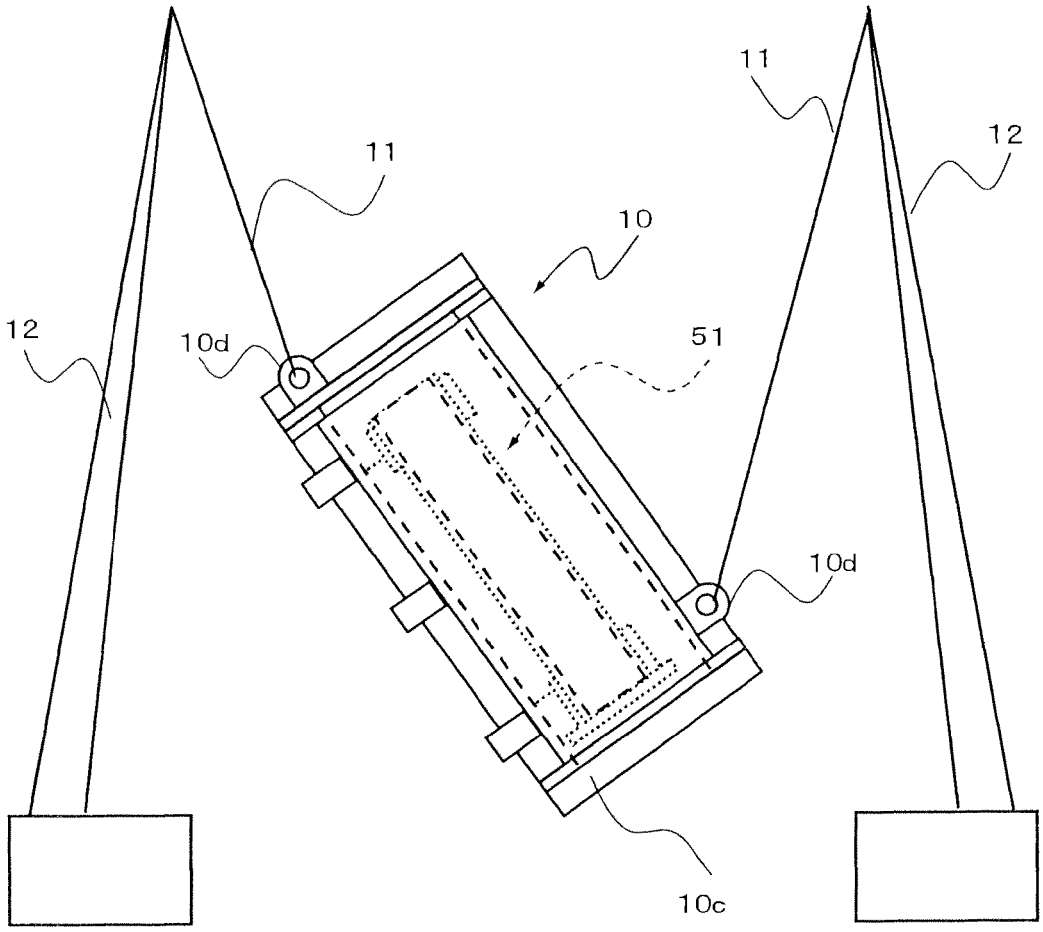
FIG. 7 is a schematic elevation view showing an erecting process of the erection tank of FIG. 6.

FIG. 6 is a schematic plan view showing a state where the U-shaped iron core 51 is housed in an erection tank 10 and a third opening portion 20*a* is closed. FIG. 7 is a schematic view showing a state where the erection tank 10 of FIG. 6 is erected.

As shown in FIGS. 1 and 2, the U-shaped iron core 51 is constituted by a first leg iron core 1*a*, a second leg iron core 1*b*, a lower-yoke iron core 6, and the like.

The U-shaped iron core 51 that has been assembled in a factory is housed in a tank obtained by connecting a first leg iron core tank 2*a* and a second leg iron core tank 2*b* in a sideways attitude.

The first leg iron core tank 2*a* has an opening/closing first longitudinal opening portion 3*a* formed in one side surface in the longitudinal direction and a first short opening portion 4*a* formed in the end surface perpendicular to the one side surface. Another opening portion may be optionally formed in the end surface opposed to the first short opening portion 4*a*. Like the first leg iron core tank 2*a*, the second leg iron core tank 2*b* has an opening/closing second longitudinal opening portion 3*b* formed in one side surface in the longitudinal direction and a second short opening portion 4*b* formed in the end surface perpendicular to the one side surface. Another opening portion may be formed in the end surface opposed to the second short opening portion 4*b*.

In a state where all the opening portions of the first leg iron core tank 2*a* and the second leg iron core tank 2*b* are opened, the longitudinal cross-section of the tank has a U-shape with an opening and two right angled corners. A flange portion, etc., is formed around these opening portions so as to allow connection between the respective tanks. Further, a seal material may be optionally used for sealing the opening portions at the time when the tanks are connected.

In a state where the U-shaped iron core 51 is housed, at least the first longitudinal opening portion 3*a* and the second longitudinal opening portion 3*b* are connected to each other in a face to face manner in a state where they are opened. At this time, the first leg iron core 1*a* and the second leg iron core 1*b* are fixed in the tank in which the first leg iron core tank 2*a* and the second leg iron core tank 2*b* are connected.

Subsequently, the lower-yoke iron core 6 is separated from the first leg iron core 1*a* and the second leg iron core 1*b*. The fixing state of the first leg iron core 1*a* and the second leg iron core 1*b* in the tank is maintained at this time. The separated lower-yoke iron core 6 is transferred to a lower-yoke iron core transporting tank (not shown).

Then, while the fixing state of the first leg iron core 1*a* and the second leg iron core 1*b* in the tank is maintained, the connection between the first leg iron core tank 2*a* and the second leg iron core tank 2*b* is released for separation. A detachable transportation lid 160 for leg iron core tank such as an iron plate is fitted to the first longitudinal opening portion 3*a* and the first short opening portion 4*a*. Further, a first end plate 5*a* is positioned in the end surface opposed to the first short opening portion 4*a*. When the iron core, etc. is housed in the tank, the opening portions are closed by the lids and the end plates.

The detachable transportation lids 160 for leg iron core tank such as an iron plates are fitted to the second longitudinal opening portion 3*b* and the second short opening portion 4*b*. Further, a second end plate 5*b* is positioned in the end surface opposed to the second short opening portion 4*b*. When the iron core, etc. is housed in the tank, the opening portions are closed by the lids and end plate. The opening portions closed at this time are maintained in a hermetically-sealed state by a seal material.

The first leg iron core 1*a*, the second leg iron core 1*b*, and the lower-yoke iron core 6 are transported to the installation site of a transformer, etc. by the first leg iron core tank 2*a*, the second leg iron core tank 2*b*, and the lower-yoke iron core transporting tank, respectively. At this time, the first leg iron core 1*a* and the second leg iron core 1*b* are housed in the first leg iron core tank 2*a* and the second leg iron core tank 2*b* respectively in a sideways attitude such that the longitudinal direction thereof is oriented in the horizontal direction and respective stacked steel plates extend in the horizontal direction and are transported in this state. At the transportation time, the lids and end plates are fitted to the opening portions of the first leg iron core tank 2*a*, the second leg iron core tank 2*b*, and the lower-yoke iron core transporting tank, and therefore, each tank is maintained in a hermetically-sealed state.

Next, an assembling method of the U-shaped iron core at the installation site will be described.

The first leg iron core tank 2*a* housing the first leg iron core 1*a* and the second leg iron core tank 2*b* housing the second leg iron core 1*b* are transported to the installation site of a transformer, etc. and then disposed such that the longitudinal directions of the tanks are made parallel to each other. At this time, the first short opening portion 4*a* and the second short opening portion 4*b* are arranged in the same plane, and the first longitudinal opening portion 3*a* and the second longitudinal opening portion 3*b*, which are set in an open state, are arranged opposite to each other. In this state, the first longitudinal opening portion 3*a* and the second longitudinal opening portion 3*b* are connected and the first leg iron tank 2*a* and the second leg iron core tank 2*b* are integrated to each other. A tank obtained by integrating the first leg iron core tank 2*a* and the second leg iron core tank 2*b* is referred to as an erection tank 10.

In the erection tank 10, the first short opening portion 4*a* and the second short opening portion 4*b* are arranged in a single plane. These opening portions 4*a* and 4*b* constitute one opening in an open state. This opening is referred to as an erection tank opening portion 10*b*. After the formation of the erection tank 10, the flanges formed around the first short opening portion 4*a* and the second short opening portion 4*b* constitute one flange. The thus obtained flange is referred to as an erection tank flange 10*a*. Further, the erection tank 10 has an erection tank hoisting lug 10*d* to which a wire, etc. can be secured.

The lower-yoke iron core 6 is transported to the installation site by the lower-yoke iron core transporting tank. A lower-yoke iron core assembling tank 20 has an opening/closing third opening portion 20*a* through which carry-in and carry-out of the lower-yoke iron core 6 can be performed. The third opening portion 20*a* is formed in one longitudinal side thereof and which has a flange portion formed therearound. The flange formed around the third opening portion 20*a* is referred to as a third opening portion flange 20*b*. At the installation site, the lower-yoke iron core 6 is carried out from the lower-yoke iron core transporting tank by, e.g., a crane or tow truck and carried in the lower-yoke iron core transporting tank through the third opening portion 20*a*. At this time, the lower-yoke iron core 6 is carried into the lower-yoke iron core assembling tank 20 in such a manner that the longitudinal direction thereof is horizontal.

The lower-yoke iron core assembling tank 20 in which the lower-yoke iron core 6 has been housed is disposed such that the erection tank opening portion 10*b* and third opening portion 20*a* are opposed to each other. In this state, the angle defined by a side surface in which the first longitudinal opening portion 3*a* and the second longitudinal opening portion 3*b* are formed and a surface having the third opening portion 20*a* is set to 90□. In FIGS. 1 and 2, the lower-yoke iron core 6 is shown in the erection tank 10 and lower-yoke iron core assembling tank 20, respectively.

In a state where the erection tank opening portion 10*b* and third opening portion 20*a* are opened, the erection tank flange 10*a* and third opening portion flange 20*b* are connected so as to integrate the erection tank 10 and lower-yoke iron core assembling tank 20. The thus obtained tank is referred to as a U-shaped iron core transporting/assembling tank 50.

Immediately after the formation of the U-shaped iron core transporting/assembling tank 50, the first leg iron core 1*a* and the second leg iron core 1*b* are disposed parallel to each other such that the extend lines of the leg iron cores in the longitudinal direction cross at right angles with the longitudinal side of the lower-yoke iron core 6. In this state, these iron cores are kept separated. When the three tanks are connected with the lids of the opening portions removed, or when an erection tank bottom plate 10*c* is fitted after removal of the lower-yoke iron core assembling tank 20, the opening portions open not upward but in the horizontal direction. Thus, it is possible to prevent dust from entering the tank.

After that, the lower-yoke iron core 6 is connected to the end portions of the first leg iron core 1*a* and the second leg iron core 1*b* to assemble the U-shaped iron core 51. More specifically, the lower-yoke iron core 6 is inserted between the lower ends of the first leg iron core 1*a* and the second leg iron core 1*b*, and the lower-yoke iron core 6 and a lower-yoke fixing hardware 101 are secured using a binding tape 120 for example. In this process, the lower-yoke iron core 6 housed in the lower-yoke iron core assembling tank 20 is connected to the lower ends of the first leg iron core 1*a* and the second leg iron core 1*b* disposed parallel thereto. That is, when the fitting of the lower-yoke iron core 6 to the lower ends of the first leg iron core 1*a* and the second leg iron core 1*b*, the U-shaped iron core 51 is housed in the erection tank 10.

In a state where the assembly of the U-shaped iron core 51 has been completed, the longitudinal directions of the first leg iron core 1*a*, the second leg iron core 1*b*, and the lower-yoke iron core 6 are all horizontal. That is, when viewed as above, the entire integrated iron core has a U-shape.

After that, an upper portion U-shaped iron core hoisting support 105 connecting the upper end portions of the first leg iron core 1*a* and the second leg iron core 1*b* may be fitted to the U-shaped iron core 51 after the first end plate 5*a* and the second end plate 5*b* are removed, and then the first end plate 5*a* and the end plate 5*b* may be refitted.

As shown in FIG. 3, in the U-shaped iron core transporting/assembling tank 50, after the assembly of the U-shaped iron core 51 has been completed, connection between the erection tank opening portion 10*b* and third opening portion 20*a* is released. After that, the erection tank opening portion 10*b* of the erection tank 10 is closed by the erection tank bottom plate 10*c* such as an iron plate. With the above processes, a state where the assembled U-shaped iron core 51 is housed in the erection tank 10 is obtained.

Thus, in the present embodiment, it is possible to assemble the U-shaped iron core 51 in an environment almost isolated from the ambient air without using an assembling room, such as a clean house, for assembling the U-shaped iron core 51, transformer, or the like, at the installation site. This allows both assembling processes of the U-shaped iron core 51 and, e.g., a transformer assembly clean house to be performed simultaneously, thereby reducing the entire transformer installation period and the installation cost.

Further, it is possible to erect the erection tank 10, in which the U-shaped iron core 51 is housed, by a tow truck 12 (crane truck) by rotating the U-shaped iron core 51 by substantially 90 degrees, so that the erection tank bottom plate 10*c* becomes the bottom surface. More specifically, as shown in FIG. 4, wires 11, etc. are secured to the erection tank hoisting lugs 10*d* attached to the erection tank 10, and the erection tank 10 is hoisted up by at least two tow trucks 12 followed by rotation of the erection tank 10 by 90□ so as to erect it so that the erection tank bottom plate 10*c* becomes the bottom surface. With this process, it is possible to erect the U-shaped iron core 51.

Thereafter, the first end plate 5*a* and the second end plate 5*b* of the erection tank are removed, the wire 11, etc. is secured to the upper portion U-shaped iron core hoisting support 105, and the U-shaped iron core 51 is hoisted up and moved to a predetermined position.

Second Embodiment

Figure 8:
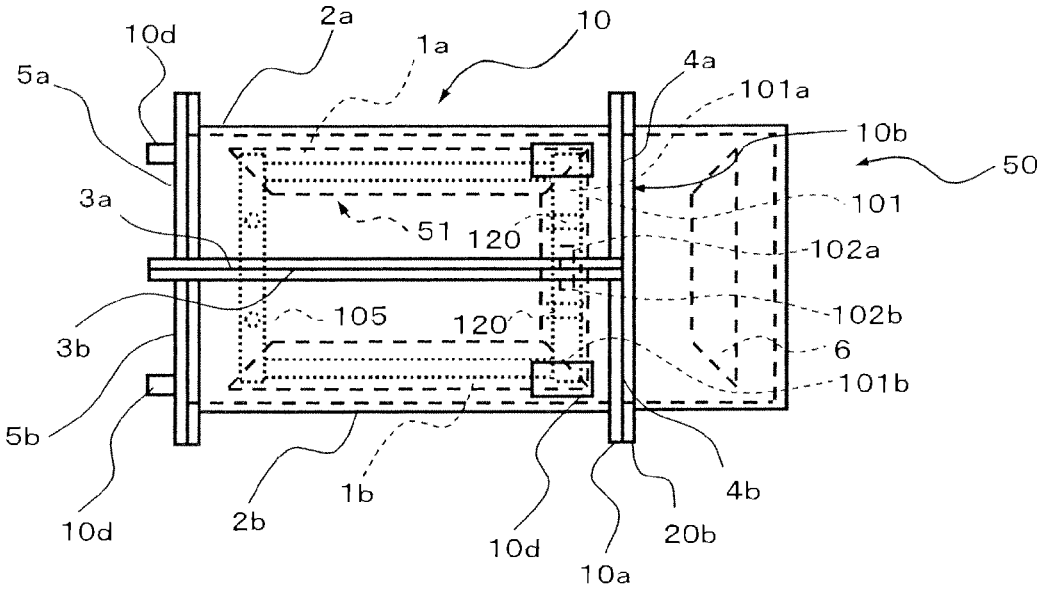
FIG. 8 shows a second embodiment of the U-shaped iron core transporting/assembling method according to the present invention, which is a schematic plan view showing an example in which a lower-yoke fixing hardware that can be divided into two parts is provided in the erection tank.
Figure 9:
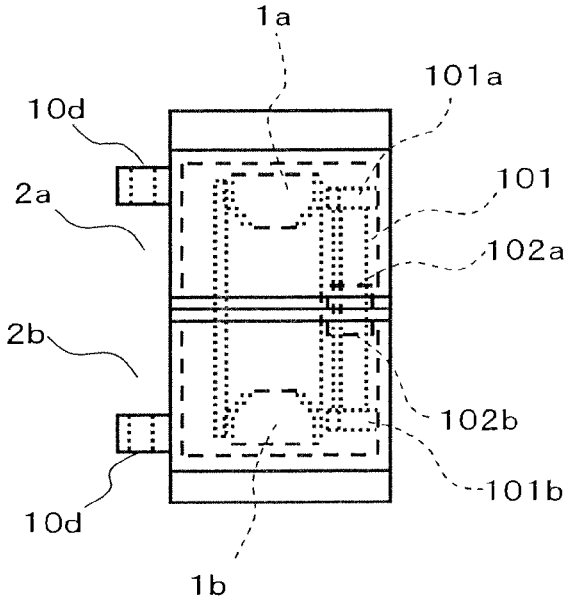
FIG. 9 is a schematic side view of the erection tank of FIG. 8.

A second embodiment of the U-shaped iron core transporting/assembling method according to the present invention will be described with reference to FIGS. 8 and 9. FIG. 8 shows the U-shaped iron core transporting/assembling tank 50 used in the present embodiment, which is a schematic plan view showing an example in which the lower-yoke fixing hardware 101 can be divided into a first lower-yoke fixing hardware 101*a* and a second lower-yoke fixing hardware 101*b*. FIG. 9 is a schematic side view of FIG. 8. The same reference numerals are given to the same or corresponding parts, and the description will not be repeated.

In the present embodiment, the lower-yoke fixing hardware 101 is designed so as to be divided at substantially the center thereof into a first lower-yoke fixing hardware 101*a* and a second lower-yoke fixing hardware 101*b*. The first lower-yoke fixing hardware 101*a* and the second lower-yoke fixing hardware 101*b* have a first lower-yoke fixing hardware connection seat 102*a* and a second lower-yoke fixing hardware connection seat 102*b*, respectively so as to be connected to each other.

At the time when the leg iron cores are transported independently, the first leg iron core 1*a* is transported with the first lower-yoke fixing hardware 101*a* attached thereto and, similarly, the second leg iron core 1*b* is transported with the second lower-yoke fixing hardware 101*b* attached thereto.

When the first leg iron core tank 2*a* and the second leg iron core tank 2*b* are connected in the assembling process of the U-shaped iron core 51 at the installation site, first the first lower-yoke fixing hardware 101*a* and the second lower-yoke fixing hardware 101*b* are connected to each other by the first lower-yoke fixing hardware connection seat 102*a* and the second lower-yoke fixing hardware connection seat 102*b*. Then, the lower-yoke iron core 6 is inserted between the lower ends of the first leg iron core 1*a* and the second leg iron core 1*b*, and the lower-yoke iron core 6 and lower-yoke fixing hardware 101 are secured using a binding tape 120 for example.

Thus, according to the present embodiment, when the lower-yoke iron core 6 and the like are separated from the U-shaped iron core 51 in a factory for disassembled transportation, the lower-yoke fixing hardware 101 need not be removed from the U-shaped iron core 51. Accordingly, after the first leg iron core tank 2*a* and the second leg iron core tank 2*b* have been connected to each other in the assembling process of the U-shaped iron core at the installation site, the lower-yoke fixing hardware 101 need not be attached to the U-shaped iron core 51 before insertion of the lower-yoke iron core 6.

Further, since the lower-yoke fixing hardware 101 is transported in the leg iron core tanks 2*a* and 2*b* in the state of being attached to the leg iron cores 1*a* and 1*b*, it is not necessary to transport the lower-yoke fixing hardware 101 by itself, thereby reducing the number of parts to be transported to reduce transportation cost.

Third Embodiment

Figure 10:
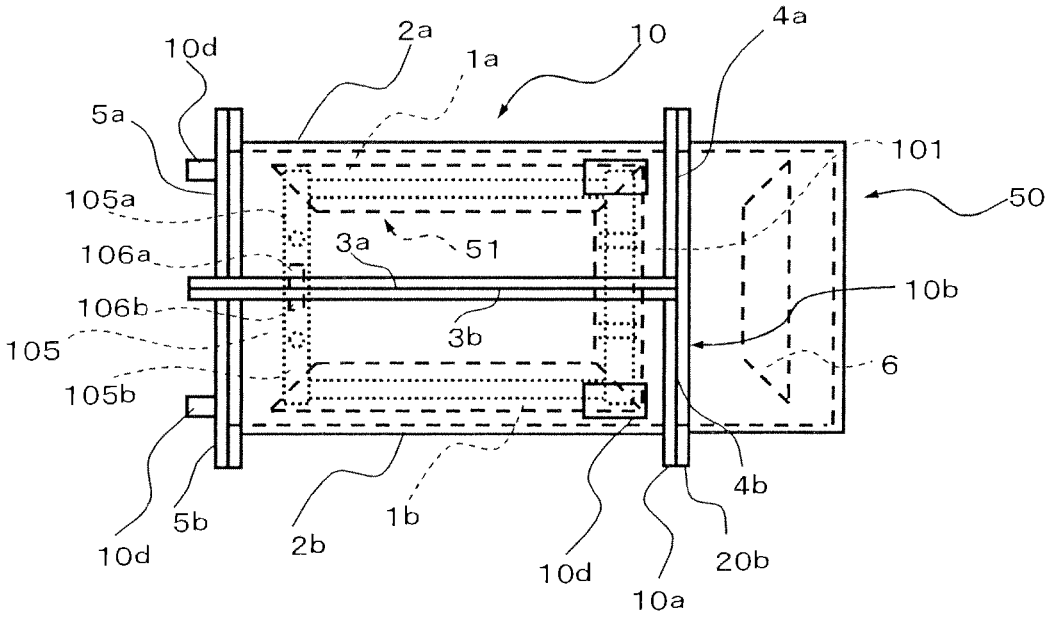
FIG. 10 shows a third embodiment of the U-shaped iron core transporting/assembling method according to the present invention, which is a schematic plan view showing an example in which an upper portion U-shaped iron core hoisting support that can be divided into two parts is provided in the erection tank.
Figure 11:
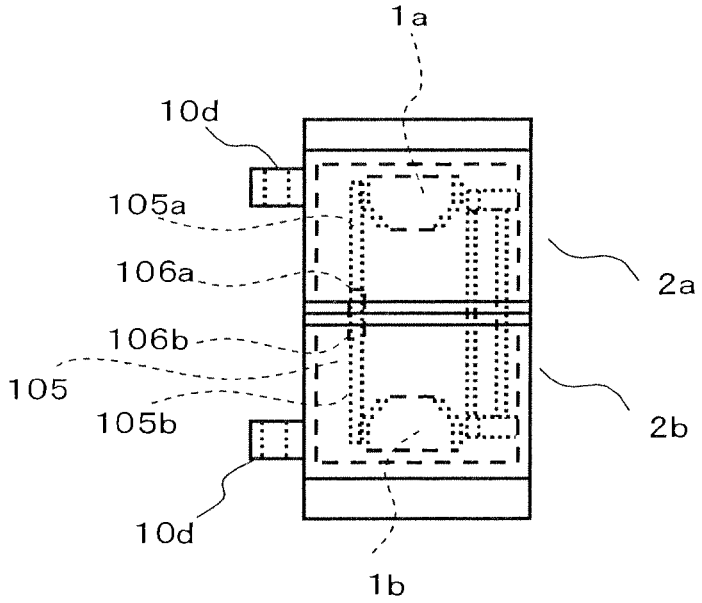
FIG. 11 is a schematic side view of the erection tank of FIG. 10.

A third embodiment of the U-shaped iron core transporting/assembling method according to the present invention will be described with reference to FIGS. 10 and 11. FIG. 10 shows the U-shaped iron core transporting/assembling tank 50 used in the present embodiment, which is a schematic plan view showing an example in which the upper portion U-shaped iron core hoisting support 105 can be divided into a first upper portion U-shaped iron core hoisting support 105*a* and a second upper portion U-shaped iron core hoisting support 105*b*. FIG. 11 is a schematic side view of FIG. 10. The same reference numerals are given to the same or corresponding parts, and the description will not be repeated.

In the present embodiment, the upper portion U-shaped iron core hoisting support 105 is designed so as to be divided at substantially the center thereof into a first upper portion U-shaped iron core hoisting support 105*a* and a second upper portion U-shaped iron core hoisting support 105*b*. The first upper portion U-shaped iron core hoisting support 105*a* and the second upper portion U-shaped iron core hoisting support 105*b* have a first upper portion U-shaped iron core hoisting support connection seat 106*a* and a second upper portion U-shaped iron core hoisting support connection seat 106*b*, respectively, so as to be connected to each other.

At the time when the leg iron cores are transported independently, the first leg iron core 1*a* is transported with the first upper portion U-shaped iron core hoisting support 105*a* attached thereto and, similarly, the second leg iron core 1*b* is transported with the second upper portion U-shaped iron core hoisting support 105*b* attached thereto.

When the first leg iron core tank 2*a* and the second leg iron core tank 2*b* are connected in the assembling process of the U-shaped iron core 51 at the installation site, first the first upper portion U-shaped iron core hoisting support 105*a* and the second upper portion U-shaped iron core hoisting support 105*b* are connected to each other by the first upper portion U-shaped iron core hoisting support connection seat 106*a* and the second upper portion U-shaped iron core hoisting support connection seat 106*b*.

Thus, according to the present embodiment, when the lower-yoke iron core 6 and the like are separated from the U-shaped iron core 51 in a factory for disassembled transportation, the upper portion U-shaped iron core hoisting support 105 need not be removed from the U-shaped iron core 51. Accordingly, after the first leg iron core tank 2*a* and the second leg iron core tank 2*b* have been connected to each other in the assembling process of the U-shaped iron core 51 at the installation site, it is possible to easily obtain a state where the upper portion U-shaped iron core hoisting support 105 has been attached to the leg iron cores 1*a* and 1*b*.

Further, since the upper portion U-shaped iron core hoisting support 105 is transported in the first leg iron core tank 2*a* and the second leg iron core tank 2*b* in the state of being attached to the leg iron cores 1*a* and 1*b*, it is not necessary to transport the upper portion U-shaped iron core hoisting support 105 by itself, thereby reducing the number of parts to be transported to reduce transportation cost.

Fourth Embodiment

Figure 12:
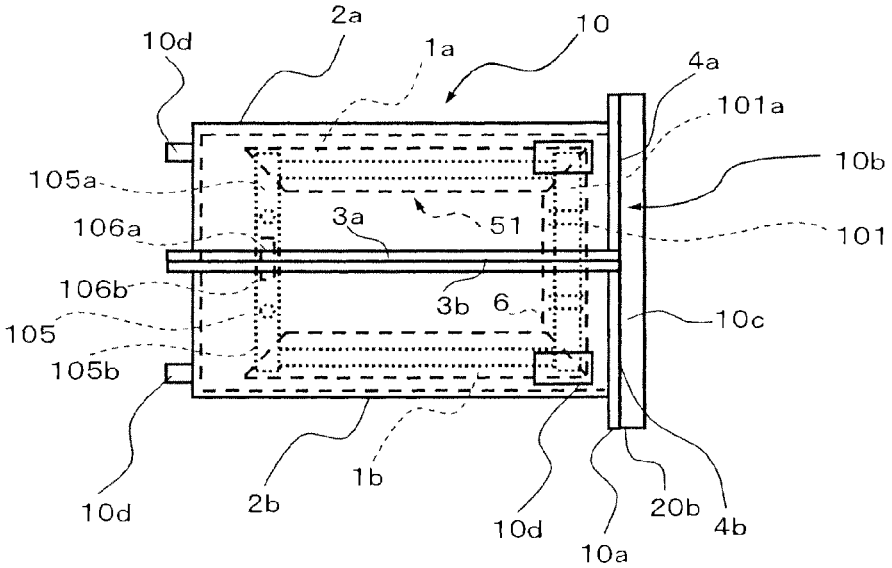
FIG. 12 shows a fourth embodiment of the U-shaped iron core transporting/assembling method according to the present invention, which is a schematic plan view showing an example in which the side surface opposite to an erection tank opening portion is closed.
Figure 13:
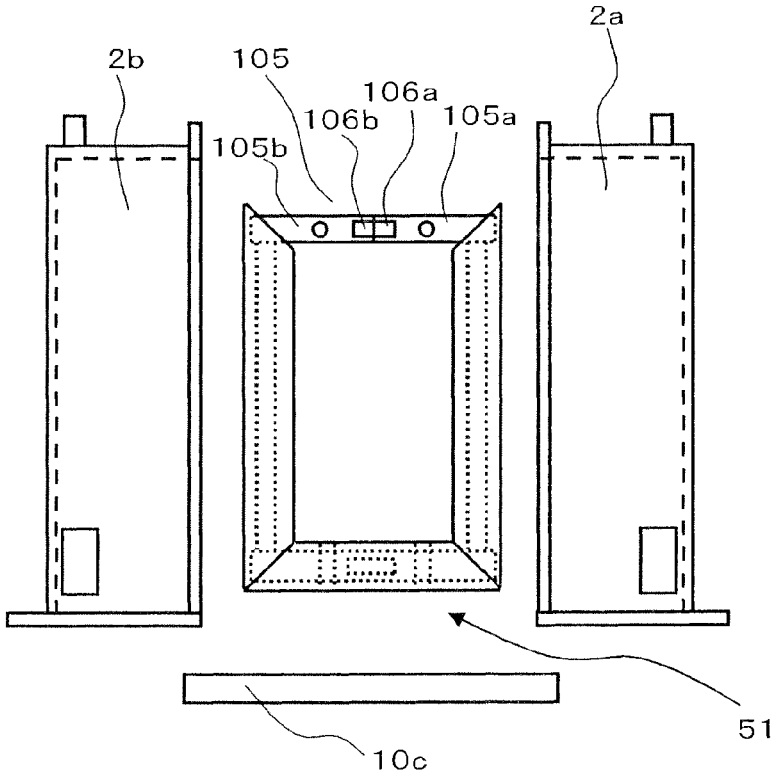
FIG. 13 is a schematic front view showing an example in which the U-shaped iron core is taken out of the erection tank by use of the erection tank of FIG. 12.

A fourth embodiment of the U-shaped iron core transporting/assembling method according to the present invention will be described with reference to FIGS. 12 and 13. FIG. 12 shows the erection tank 10 used in the present embodiment, which is a schematic plan view showing an example in which the side surface opposite to the erection tank opening portion 10*b* is closed. FIG. 13 is a schematic front view showing an example in which the U-shaped iron core 51 is taken out of the erection tank 10. The same reference numerals are given to the same or corresponding parts, and the description will not be repeated.

In the present embodiment, the side surface opposite to the erection tank opening portion 10*b* is closed. The present embodiment can be practiced by use of the configuration of the third embodiment in which the first upper portion U-shaped iron core hoisting support 105*a* and the second upper portion U-shaped iron core hoisting support 105*b* are connected to each other in the erection tank 10.

This eliminates the need to provide the end plates 5*a* and 5*b*. Further, the side surface opposite to the erection tank opening portion 10*b* need not be opened/closed, so that it is possible to prevent foreign matters from entering the erection tank 10.

As shown in FIG. 13, in the present embodiment, the first leg iron core tank 2*a* and the second leg iron core tank 2*b* are separated and moved in the direction away from each other after the erection tank 10 has been erected, and then the U-shaped iron core 51 is moved to a predetermined position.

Fifth Embodiment

Figure 14:
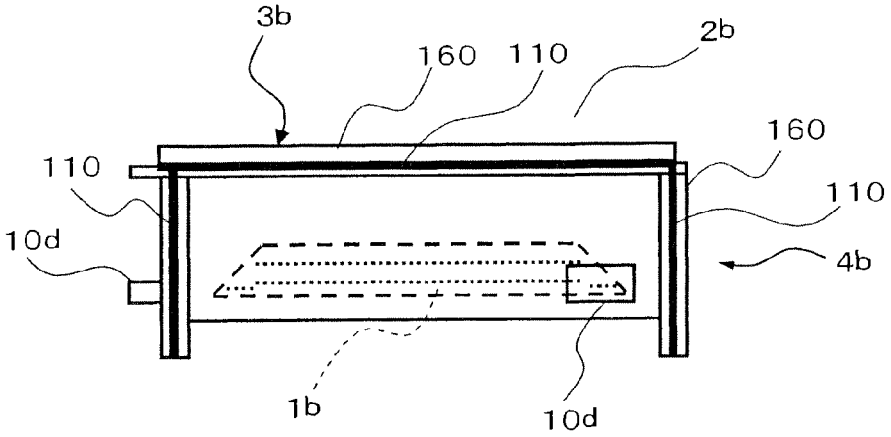
FIG. 14 shows a fifth embodiment of the U-shaped iron core transporting/assembling method according to the present invention, which is a schematic plan view showing an example in which an opening portion gasket is provided in the opening portions of the erection tank.
Figure 15:
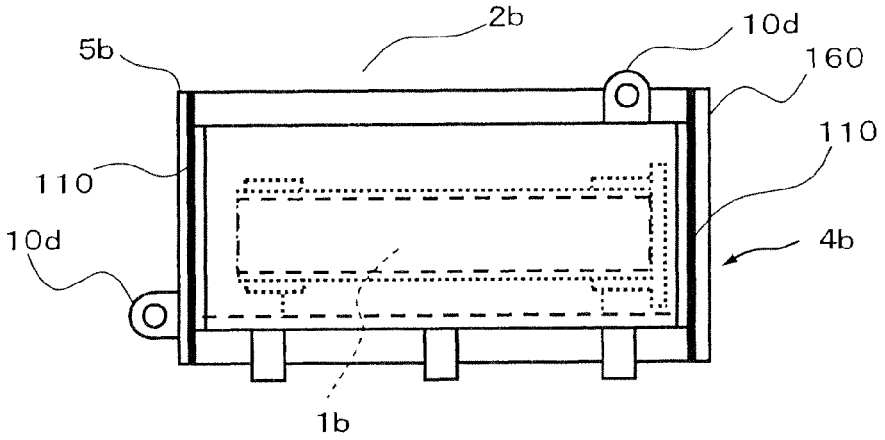
FIG. 15 is a schematic front view of the second leg iron core tank of FIG. 14.
Figure 16:
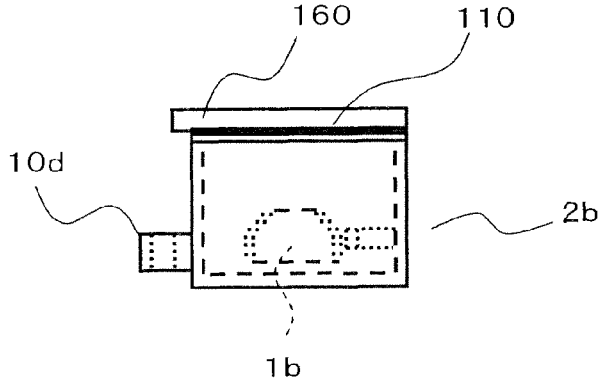
FIG. 16 is a schematic side view of the second leg iron core tank of FIG. 14.

A fifth embodiment of the U-shaped iron core transporting/assembling method according to the present invention will be described with reference to FIGS. 14, 15, and 16. FIG. 14 shows the second leg iron core tank 2*b* used in the present embodiment, which is a schematic plan view showing an example in which an opening portion gasket 110 is provided in the opening portions. FIG. 15 is a schematic front view of FIG. 14, and FIG. 16 is a schematic side view of FIG. 14. The same reference numerals are given to the same or corresponding parts, and the description will not be repeated.

In the present embodiment, as shown in FIGS. 14 to 16, an opening portion gasket 110 is provided in the second leg iron core tank 2*b* at its opening portions including the second longitudinal opening portion 3*b*, the second short opening portion 4*b*, and the opening portion opposite to the second short opening portion 4*b*. Similarly, although not shown, the opening portion gasket 110 is provided in the first leg iron core tank 2*a* at its opening portions including the first longitudinal opening portion 3*a*, the first short opening portion 4*a*, and opening portion opposite to the first short opening portion 4*a*. These opening portions have a sealable structure. That is, lids such as an iron plate are fitted to the opening portion gasket 110 provided at the flange portion, and bolts, etc. are tightened on the lids.

With this configuration, at the time when the iron core is transported, the first leg iron core tank 2*a* and the second leg iron core tank 2*b* can be hermetically sealed by means of dry air or dry nitrogen encapsulation. This prevents water and foreign matters from entering the transporting tank even in the case where delay occurs in the transporting process. In addition, it is possible to prevent oxidization of the iron core and adherence of foreign matters to the iron core.

Thus, according to the present embodiment, the first leg iron core 1*a* and the second leg iron core 1*b* can be transported to the installation site with the high quality thereof maintained.

Sixth Embodiment

Figure 17:
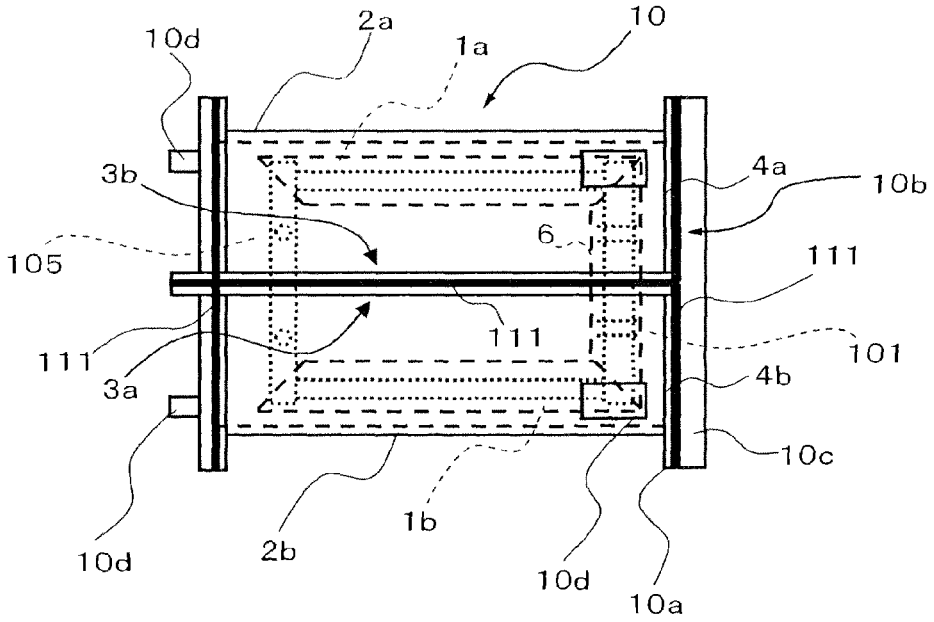
FIG. 17 shows a sixth embodiment of the U-shaped iron core transporting/assembling method according to the present invention, which is a schematic plan view showing an example in which a connection portion gasket is provided at the connection portion of the longitudinal opening portion of the second leg iron core tank.

A sixth embodiment of the U-shaped iron core transporting/assembling method according to the present invention will be described with reference to FIG. 17. FIG. 17 shows the erection tank 10 used in the present embodiment, which is a schematic plan view showing an example in which a connection portion gasket 111 is provided at the connection portion between the first longitudinal opening portion 3*a* and the second longitudinal opening portion 3*b*. The same reference numerals are given to the same or corresponding parts, and the description will not be repeated.

In the present embodiment, a connection portion gasket 111 is provided at the flange portions of the longitudinal opening portions 3*a* and 3*b*. That is, with the connection portion gasket 111 interposed between the flanges of the longitudinal opening portions 3*a* and 3*b*, bolts, etc. are used to fasten the flanges. Similarly, the connection portion gasket 111 is also provided at the erection tank flange 10*a* and end surface opposite to the erection tank flange 10*a*. The connection portion gasket 111 provided at the erection tank flange 10*a* is effective in both the cases where the erection tank bottom plate 10*c* is connected to the erection tank 10 and where the lower-yoke iron core assembling tank 20 is connected to the erection tank 10.

With this configuration, at any stage of during the assembly of the U-shaped iron core 51, after the assembly thereof, and after the erection thereof, the erection tank 10 can be hermetically sealed by means of dry air or dry nitrogen encapsulation. This prevents water and foreign matters from entering the transporting tank even in the case where the U-shaped iron core 51 needs to be kept for long period of time and thereby prevents oxidization of the iron core and adherence of foreign matters to the iron core.

Thus, according to the present embodiment, the first leg iron core 1*a* and the second leg iron core 1*b* can be transported to the installation site with the high quality thereof maintained.

Seventh Embodiment

Figure 18:
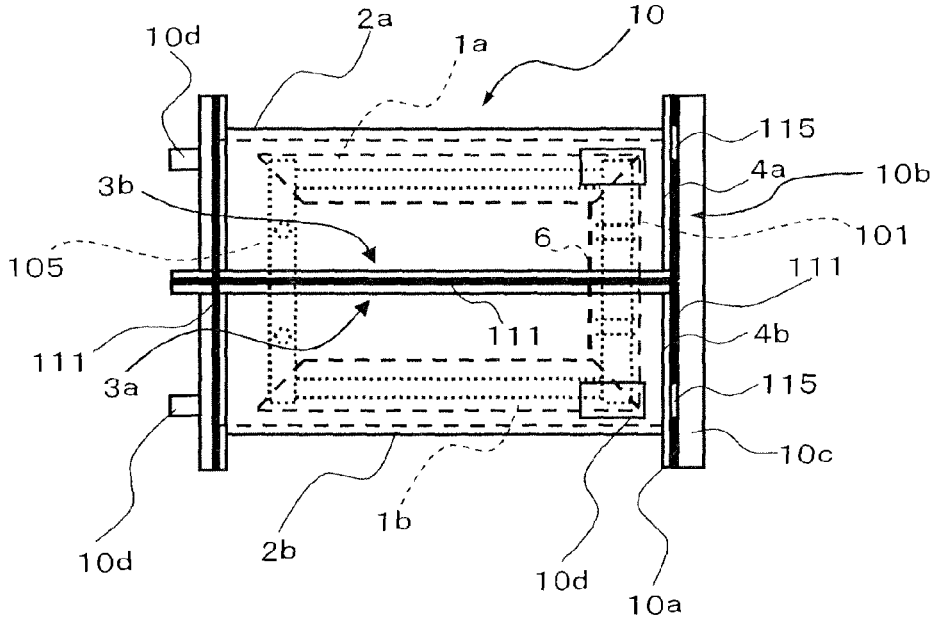
FIG. 18 shows a seventh embodiment of the U-shaped iron core transporting/assembling method according to the present invention, which is a schematic plan view showing an example in which a spacer plate is provided at the flange portion of the erection tank.

A seventh embodiment of the U-shaped iron core transporting/assembling method according to the present invention will be described with reference to FIG. 18. FIG. 18 shows the erection tank 10 used in the present embodiment, which is a schematic plan view showing an example in which spacer plates 115 are provided at the flange portion such as the tank connection portion. The same reference numerals are given to the same or corresponding parts, and the description will not be repeated.

As shown in the fifth and sixth embodiments, in the case where the connection portion gasket 111 is provided at the connection portion and the like, the fastening using bolts, etc. changes the thickness of the gasket. This may lead to a change in the positions of the leg iron cores 1*a* and 1*b* that have been fixed to the leg iron tanks 2*a* and 2*b* in a factory. In this case, in order to restore the positions of the tanks to those before disassembly, it is necessary to previously measure the gasket thickness before assembly and connect the tanks while adjusting the fastening force of the bolts, etc. so that the gasket thickness is equal to the gasket thickness before disassembly.

In the present embodiment, to simplify the above connecting process, spacer plates 115 are provided at the flange portion of at least one of the first longitudinal opening portion 3*a* and the second longitudinal opening portion 3*b*. The spacer plates 115 may be optionally provided at the erection tank flange 10*a* and end surface opposite to the erection tank flange 10*a*.

With this configuration, it is possible to easily assemble the U-shaped iron core 51 without performing adjustment of the dimension or level between the two leg iron cores 1*a* and 1*b*, thereby reducing assembly man hours and installation period.

Eighth Embodiment

Figure 19:
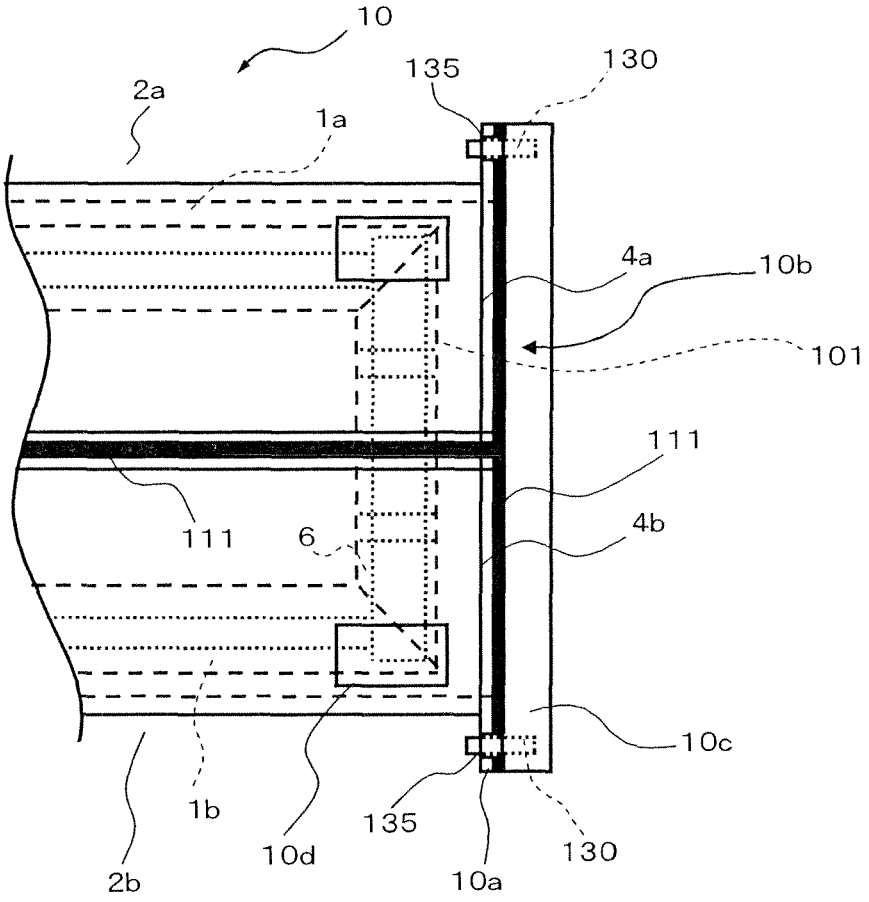
FIG. 19 shows an eighth embodiment of the U-shaped iron core transporting/assembling method according to the present invention, which is an enlarged plan view showing an example in which the leg iron core tank is fixed by means of position fixing pins inserted through pin insertion holes formed in the leg iron cores.

An eighth embodiment of the U-shaped iron core transporting/assembling method according to the present invention will be described with reference to FIG. 19. FIG. 19 shows the erection tank 10 used in the present embodiment, which is an enlarged plan view showing an example in which the first leg iron core tank 2*a* and the second leg iron core tank 2*b* are fixed together by means of position fixing pins 130 inserted through pin insertion holes 135 formed in the first leg iron core tank 2*a* and the second leg iron core tank 2*b*. The same reference numerals are given to the same or corresponding parts, and the description will not be repeated.

The diameter of bolt holes into which bolts for connecting the leg iron core tanks 2*a* and 2*b* needs to be made larger than the outer diameter of the bolts by about 4 to 5 mm. In this case, it is likely that the positions of the tanks may be shifted by a difference between the bolt hole diameter and bolt outer diameter. Thus, in order to restore the positions of the tanks to those at the assembly time in a factory, i.e., those before disassembly, it is necessary to draw guide lines, before disassembly, on the surface of the connection portion between the leg iron core tanks 2*a* and 2*b*, for example, the surfaces of the flange portions of the longitudinal opening portions 3*a* and 3*b* and connects the tanks while adjusting the positions of the tanks with reference to the guide lines.

In the present embodiment, in order to simplify the above connecting process, pin insertion holes 135 are formed so as to penetrate the flange portion connecting the leg iron core tanks 2*a* and 2*b*, for example, the erection tank flange 10*a*. In the example of FIG. 19, the pin insertion holes 135 are formed in the erection tank flange 10*a*. Position fixing pins 130 are inserted through the pin insertion holes 135, and leg iron core tanks 2*a* and 2*b* are transported to the installation site with the assembly state in the factory maintained. The pin insertion holes 135 may be formed in the longitudinal opening portions 3*a* and 3*b*, side surface opposite to the erection tank flange 10*a*, or the like.

With this configuration, it is possible to easily restore the positional relationship between tanks to the state before disassembly simply by inserting the position fixing pins 130 through the pin insertion holes 135 at the time of connection of the tanks.

This eliminates the need to employ an assembling table which has been generally used in assembly of the U-shaped iron core 51 and need to perform adjustment of the dimension or level between the two leg iron cores 1*a* and 1*b*, thereby reducing assembly man hours and installation period of the U-shaped iron core 51.

Ninth Embodiment

Figure 20:
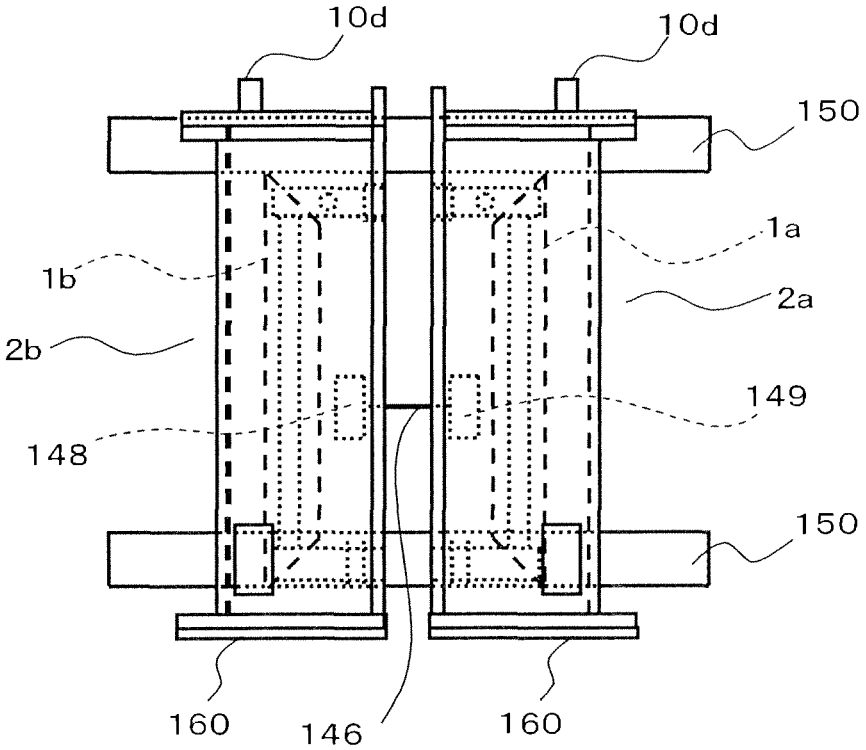
FIG. 20 shows a ninth embodiment of the U-shaped iron core transporting/assembling method according to the present invention, which is a schematic plan view showing an example in which the erection tank is formed using a connection wire.
Figure 21:
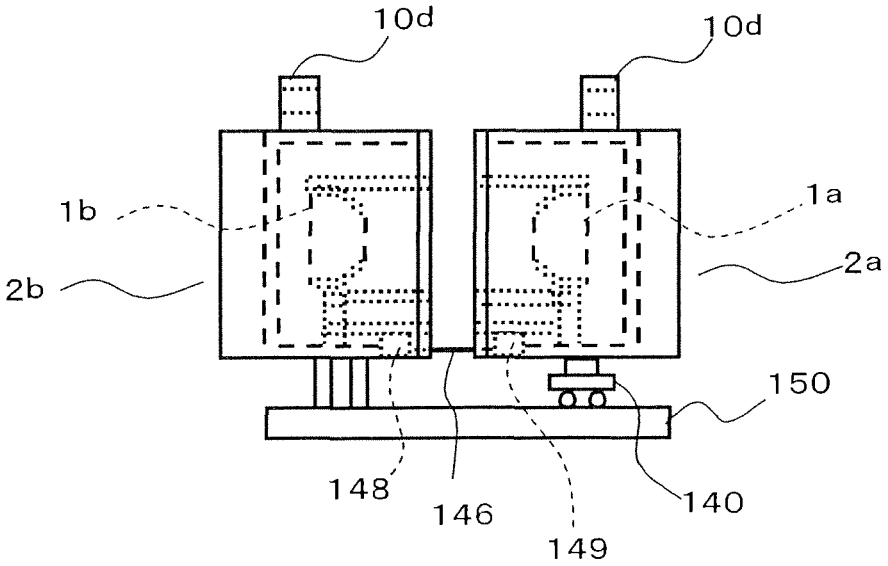
FIG. 21 is a schematic side view of the erection tank of FIG. 20.

A ninth embodiment of the U-shaped iron core transporting/assembling method according to the present invention will be described with reference to FIGS. 20 and 21. FIG. 20 shows the erection tank 10 used in the present embodiment, which is a schematic plan view showing an example in which the erection tank 10 is formed using a connection wire 146. FIG. 21 is a schematic side view of FIG. 20. The same reference numerals are given to the same or corresponding parts, and the description will not be repeated.

In the present embodiment, a wire winder 148 is provided in the first leg iron core tank 2*a*, and a wire mounting seat 149 is provided in the second leg iron core tank 2*b*. Further, a sliding jig 140 is attached to the second leg iron core tank 2*b*. The leg iron core tanks 2*a* and 2*b* are disposed on an assembling stand 150.

The second leg iron core tank 2*b* can be slid on the assembling stand 150 by the sliding jig 140.

The sliding jig 140 may be attached to the first leg iron core tank 2*a* so as to allow the first leg iron core tank 2*a* to be slid. Alternatively, the sliding jig 140 may be attached to both the two leg iron cores 2*a* and 2*b*.

In the present embodiment, a connection wire 146 is installed to the wire winder 148 and wire mounting seat 149, and the wire 148 is used to slide the second leg iron core tank 2*b* for connection to the first leg iron core tank 2*a*, whereby the erection tank 10 is formed.

This eliminates the need to perform delicate position adjustment at the time when the tanks are connected, thereby further simplifying the connecting process. Further, there is no need to hoist up the leg iron core tanks 2*a* and 2*b*, so that it is possible to complete the assembling process of the erection tank 10 only with a crane truck with small hoisting capacity. Thus, it is possible to reduce cost involved in the assembly work at the installation site, assembly man hours, and installation period.

Tenth Embodiment

Figure 22:
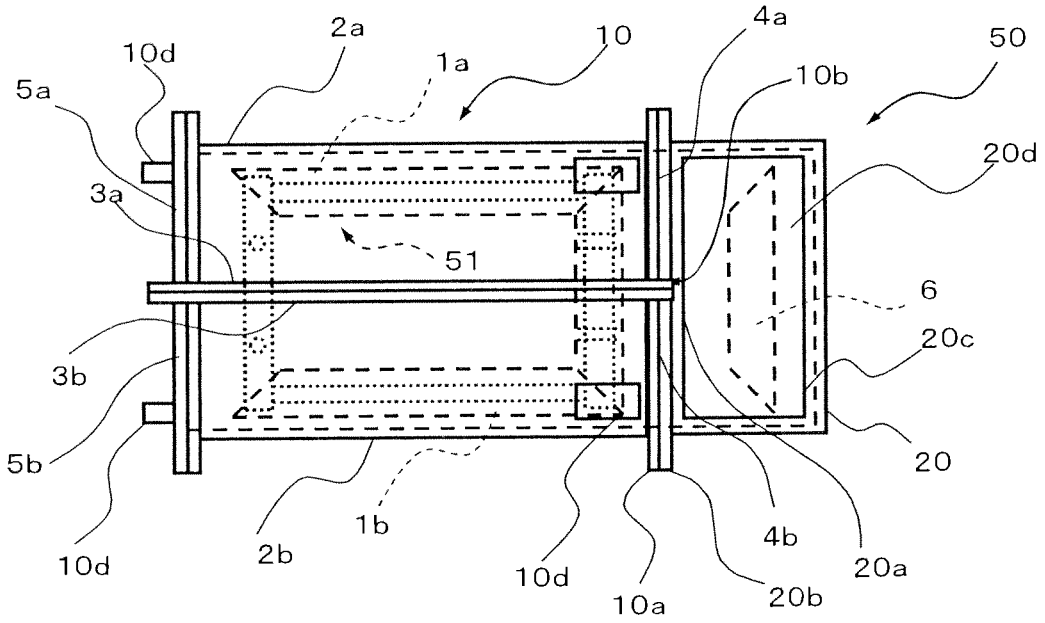
FIG. 22 shows a tenth embodiment of the U-shaped iron core transporting/assembling method according to the present invention, which is a schematic plan view showing an example in which an upper surface opening portion is formed in the lower-yoke iron core assembling tank.

A tenth embodiment of the U-shaped iron core transporting/assembling method according to the present invention will be described with reference to FIG. 22. FIG. 22 shows the U-shaped iron core transporting/assembling tank 50 used in the present embodiment, which is a schematic plan view showing an example in which an upper surface opening portion 20*c* is formed in the lower-yoke iron core assembling tank 20. The same reference numerals are given to the same or corresponding parts, and the description will not be repeated.

In the present embodiment, an upper surface opening portion 20*c* is formed in one surface of the lower-yoke iron core assembling tank 20 which is perpendicular to the third opening portion 20*a* and which becomes the upper surface when the lower-yoke iron core assembling tank 20 is connected to the erection tank 10.

By forming the upper surface opening portion 20*c*, it is possible to carry the lower-yoke iron core 6 in the lower-yoke iron core assembling tank 20 irrespective of before or after connection between the lower-yoke iron core assembling tank 20 and erection tank 10 has been completed as long as the lower-yoke iron core assembling tank 20 and erection tank have been arranged such that the erection tank opening portion 10*b* and third opening portion 20*a* are opposed to each other. Further, in this example, materials and the like required for the assembly of the U-shaped iron core can be carried in the lower-yoke iron core assembling tank 20 even after the lower-yoke iron core assembling tank 20 has been connected to the erection tank 10, thereby improving workability.

An upper surface lid 20*d* such as an iron plate is fitted to the upper surface opening portion 20*c* of the present embodiment. That the upper surface opening portion 20*c* is in a closed state when the iron core and the like are being housed or during transportation. At the closed state, the upper surface opening portion 20*c* and upper surface lid 20*d* are sealed by a packing so as to prevent ambient air from entering the lower-yoke iron core assembling tank 20.

Eleventh Embodiment

Figure 23:
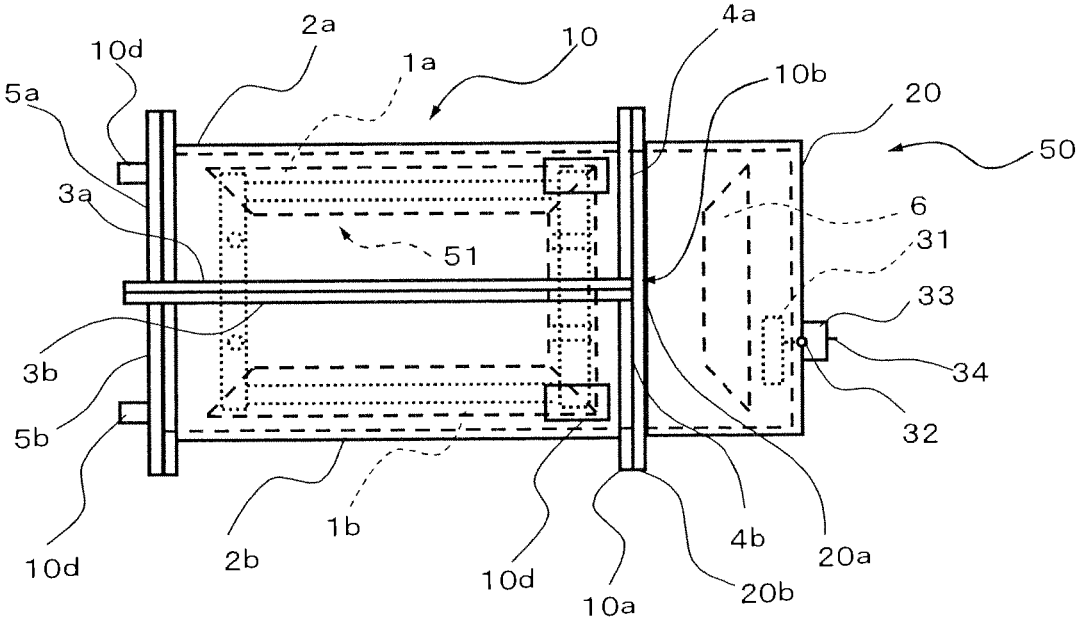
FIG. 23 shows an eleventh embodiment of the U-shaped iron core transporting/assembling method according to the present invention, which is a schematic plan view showing an example in which a dehumidifier is provided in the lower-yoke iron core assembling tank.
Figure 24:
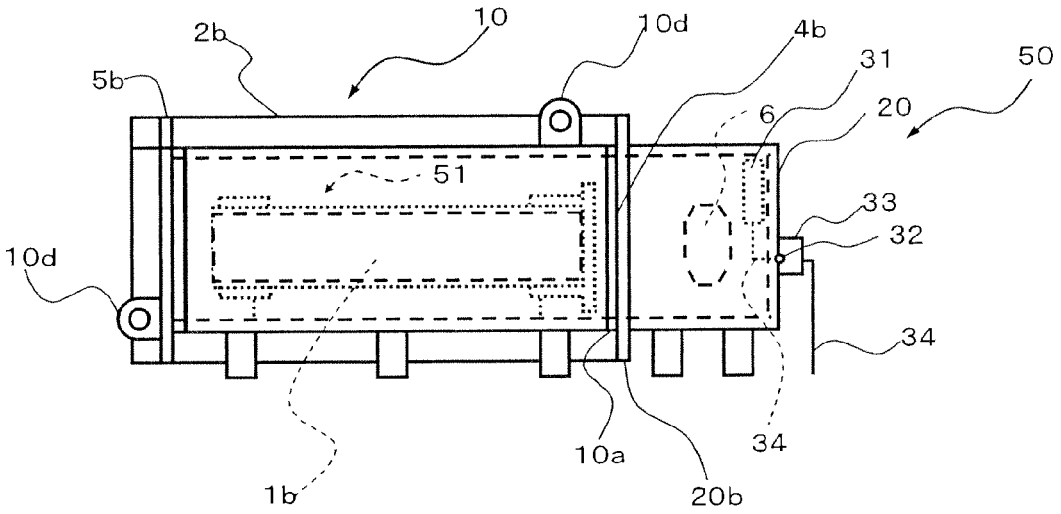
FIG. 24 is a schematic front view of U-shaped iron core transporting/assembling tank of FIG. 23.

An eleventh embodiment of the U-shaped iron core transporting/assembling method according to the present invention will be described with reference to FIGS. 23 and 24. FIG. 23 shows the U-shaped iron core transporting/assembling tank 50 used in the present embodiment, which is a schematic plan view showing an example in which a dehumidifier 31, etc. is provided in the lower-yoke iron core assembling tank 20. FIG. 24 is a schematic front view of FIG. 23. The same reference numerals are given to the same or corresponding parts, and the description will not be repeated.

In the present embodiment, a dehumidifier 31 is provided inside the lower-yoke iron core assembling tank 20. A power supply unit (not shown) for driving the dehumidifier 31 is provided outside the lower-yoke iron core assembling tank 20. In this case, a terminal box 33 connecting to the power supply unit is provided at the side surface of the lower-yoke iron core assembling tank 20, and a power supply line 34 is made to pass through a through portion 32 formed in the side surface of the lower-yoke iron core assembling tank 20 so as to connect the terminal box 33 and dehumidifier 31, whereby power is supplied to the dehumidifier 31.

By use of the dehumidifier 31, the air in the U-shaped iron core transporting/assembling tank 50 can be dehumidified. Thus, it is possible to perform the installation work under the environment like a clean house in which the U-shaped iron core 51 has been assembled in a conventional method.

Twelfth Embodiment

Figure 25:
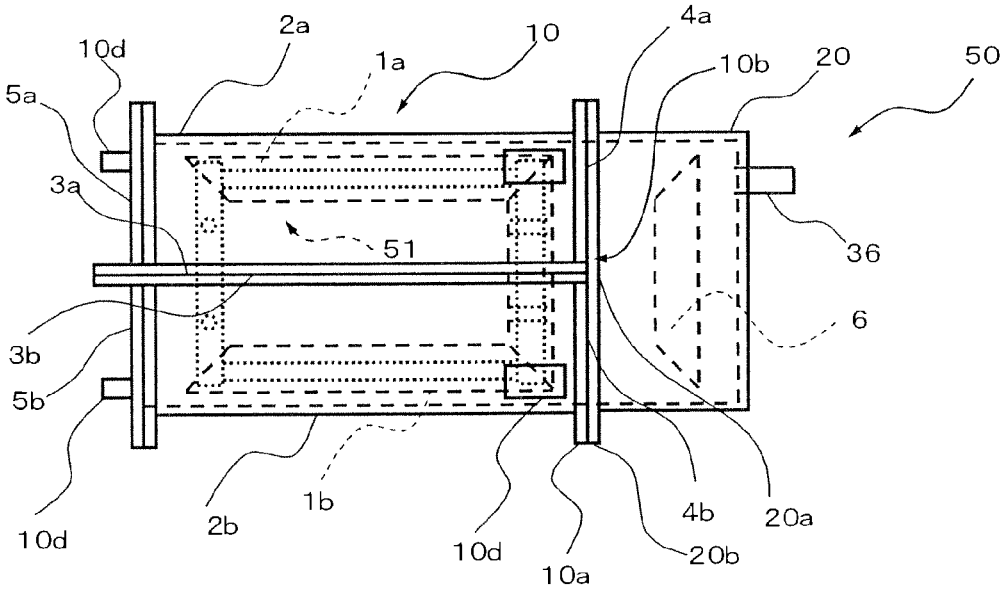
FIG. 25 shows a twelfth embodiment of the U-shaped iron core transporting/assembling method according to the present invention, which is a schematic plan view showing an example in which an air vent is provided in the lower-yoke iron core assembling tank.
Figure 26:
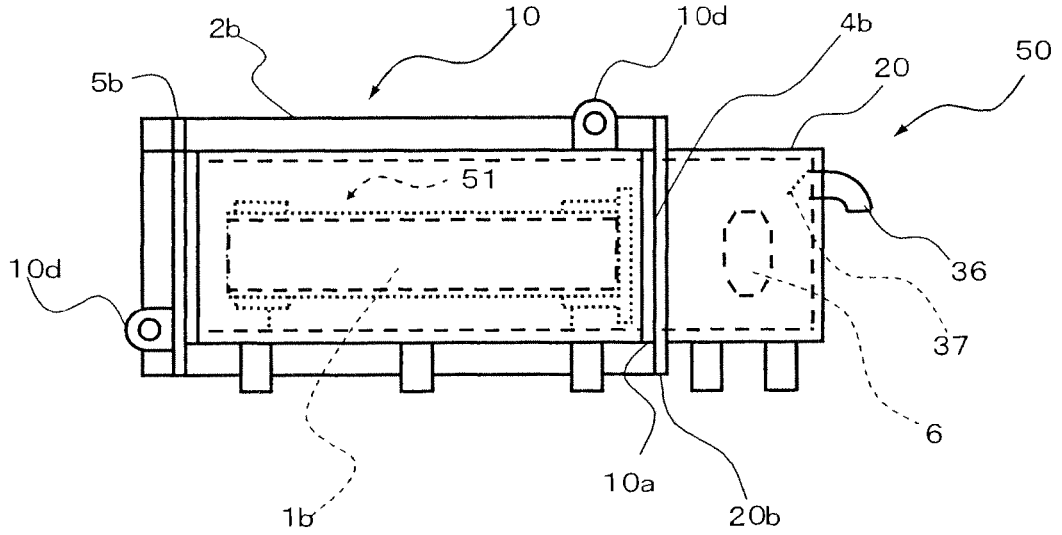
FIG. 26 is a schematic front view of U-shaped iron core transporting/assembling tank of FIG. 25.

A twelfth embodiment of the U-shaped iron core transporting/assembling method according to the present invention will be described with reference to FIGS. 25 and 26. FIG. 25 shows the U-shaped iron core transporting/assembling tank 50 used in the present embodiment, which is a schematic plan view showing an example in which an air vent 36 is provided in the lower-yoke iron core assembling tank 20. FIG. 26 is a schematic front view of FIG. 25. The same reference numerals are given to the same or corresponding parts, and the description will not be repeated.

In the present embodiment, an opening/closing air vent 36 and an air vent closing lid 37 are provided at the side surface of the lower-yoke iron core assembling tank 20.

Through the air vent 36, dry air, etc. can be introduced into the lower-yoke iron core assembling tank 20. Further, when the dehumidifier 31, etc. is provided outside the tank, dehumidification can be achieved through a pipe, etc. by use of the air vent 36. The air vent closing lid 37 is formed so as to prevent entering of ambient air, so that the condition in the U-shaped iron core transporting/assembling tank 50 is not degraded.

Thirteenth Embodiment

Figure 27:
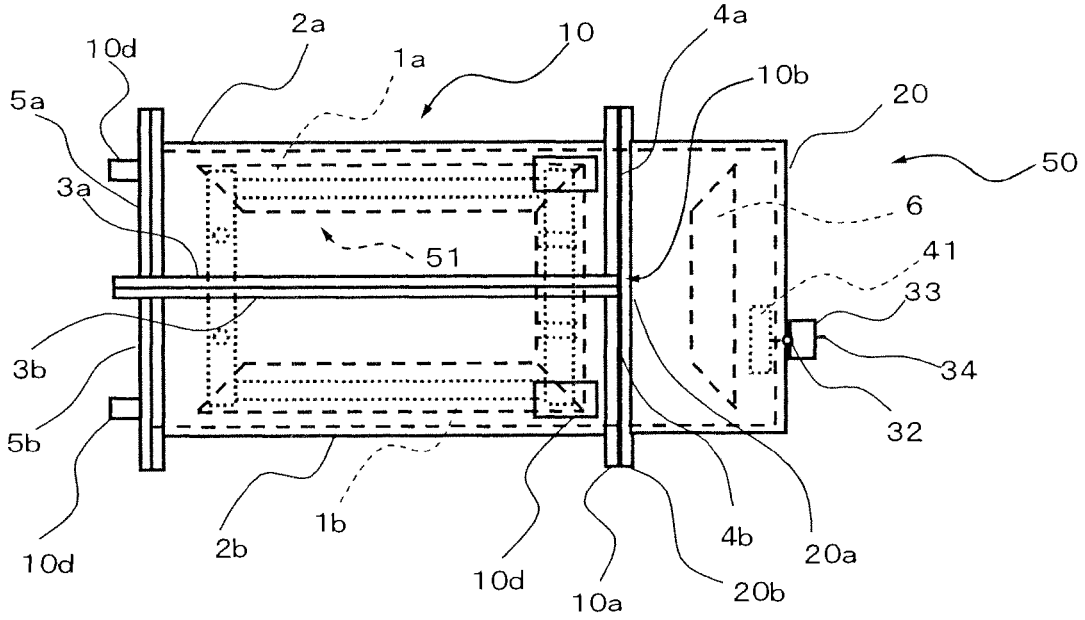
FIG. 27 shows a thirteenth embodiment of the U-shaped iron core transporting/assembling method according to the present invention, which is a schematic plan view showing an example in which a dust collector is provided in the lower-yoke iron core assembling tank.
Figure 28:
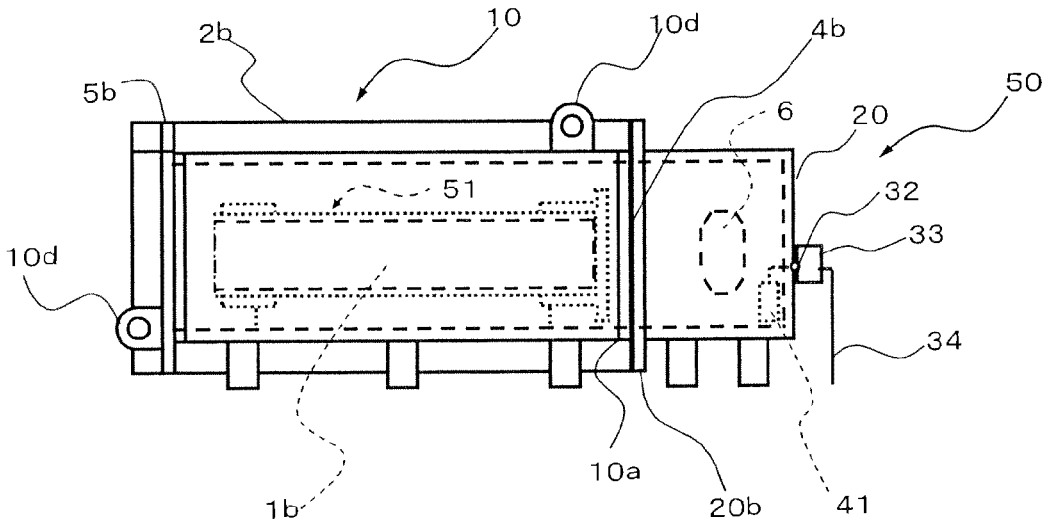
FIG. 28 is a schematic front view of U-shaped iron core transporting/assembling tank of FIG. 27.

A thirteenth embodiment of the U-shaped iron core transporting/assembling method according to the present invention will be described with reference to FIGS. 27 and 28. FIG. 27 shows the U-shaped iron core transporting/assembling tank 50 used in the present embodiment, which is a schematic plan view showing an example in which a dust collector 41, etc. is provided in the lower-yoke iron core assembling tank 20. FIG. 28 is a schematic front view of FIG. 27. The same reference numerals are given to the same or corresponding parts, and the description will not be repeated.

In the present embodiment, a dust collector 41 is provided inside the lower-yoke iron core assembling tank 20. A power supply unit for driving the dust collector 41 is provided outside the lower-yoke iron core assembling tank 20. Power supply to the dust collector 41 can be made in the same manner as in the case of the abovementioned dehumidifier 31.

By use of the dust collector 41, dust, etc. in the U-shaped iron core transporting/assembling tank 50 can be removed. Thus, it is possible to perform the installation work under the environment like a clean house in which the U-shaped iron core 51 has been assembled in a conventional method.

Fourteenth Embodiment

Figure 29:
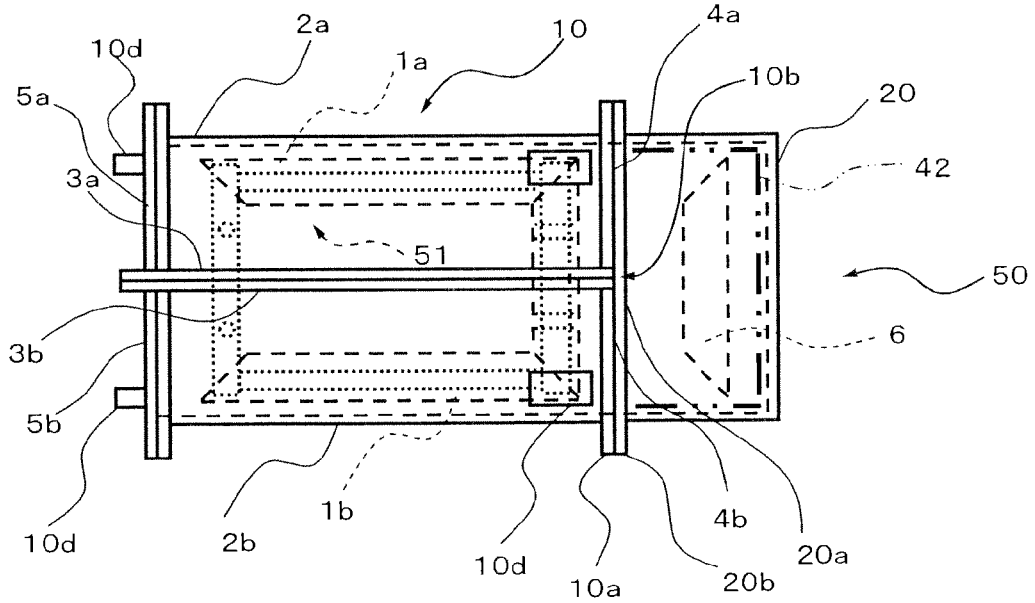
FIG. 29 shows a fourteenth embodiment of the U-shaped iron core transporting/assembling method according to the present invention, which is a schematic plan view showing an example in which the inner wall of the lower-yoke iron core assembling tank is covered by a dust-proof sheet.

A fourteenth embodiment of the U-shaped iron core transporting/assembling method according to the present invention will be described with reference to FIG. 29. FIG. 29 shows the U-shaped iron core transporting/assembling tank 50 used in the present embodiment, which is a schematic plan view showing an example in which a dust-proof sheet 42 is provided inside the lower-yoke iron core assembling tank 20. The same reference numerals are given to the same or corresponding parts, and the description will not be repeated.

In the present embodiment, a dust-proof sheet 42 is provided inside the lower-yoke iron core assembling tank 20 so as to cover the inner wall of the lower-yoke iron core assembling tank 20.

With this configuration, it is possible to suppress occurrence of dust.

Fifteenth Embodiment

Figure 30:
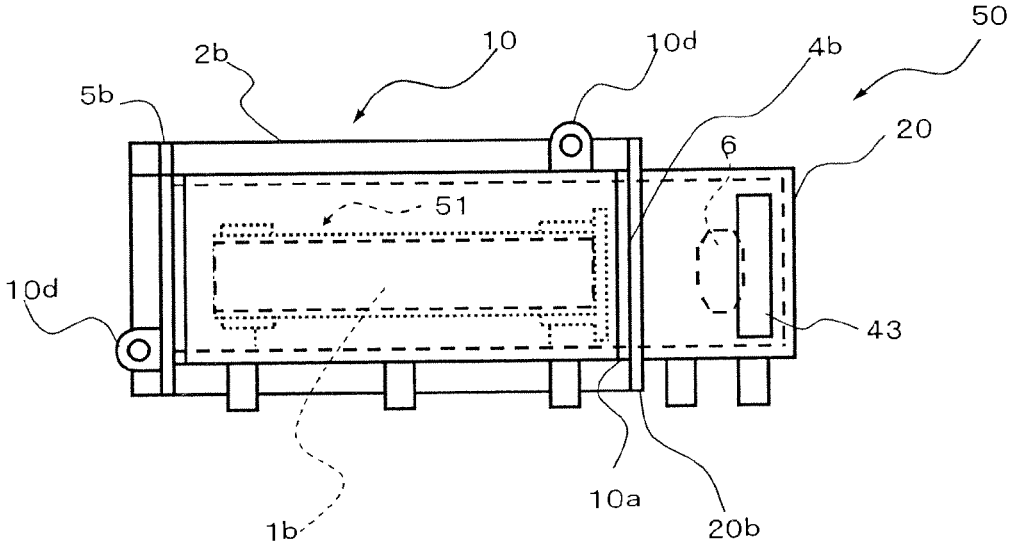
FIG. 30 shows a fifteenth embodiment of the U-shaped iron core transporting/assembling method according to the present invention, which is a schematic front view showing an example in which an operating door is formed in the lower-yoke iron core assembling tank.

A fifteenth embodiment of the U-shaped iron core transporting/assembling method according to the present invention will be described with reference to FIG. 30. FIG. 30 shows the U-shaped iron core transporting/assembling tank 50 used in the present embodiment, which is a schematic front view showing an example in which an operating door 43 is formed in the iron core assembling tank 20. The same reference numerals are given to the same or corresponding parts, and the description will not be repeated.

In the present embodiment, in order to improve workability, an operating door 43 allowing operators to enter/exit the tank is formed in the lower-yoke iron core assembling tank 20.

The operating door 43 can be formed in the side surfaces perpendicular to the third opening portion 20*a* or side surface opposite to the third opening portion 20*a*. Further, the operating door 43 is sealed by a packing, etc. so as to prevent ambient air from entering the lower-yoke iron core assembling tank 20 at its closed state. Therefore, by driving the dehumidifier 31 or dust collector 41 after entrance or exit of operators has been completed, it is possible to prevent the condition in the U-shaped iron core transporting/assembling tank 50 from being degraded.

Sixteenth Embodiment

Figure 31:
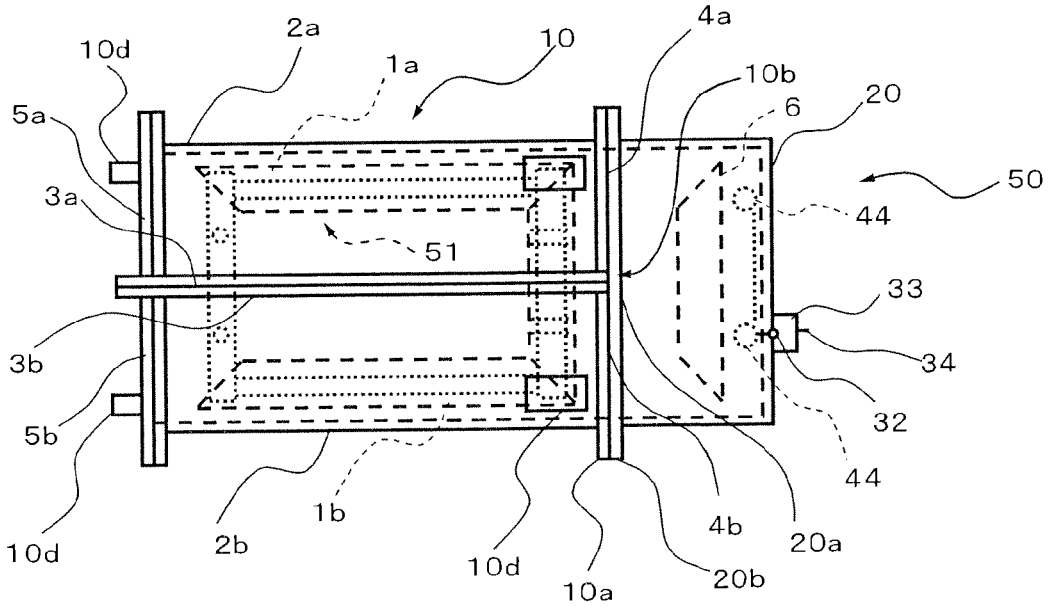
FIG. 31 shows a sixteenth embodiment of the U-shaped iron core transporting/assembling method according to the present invention, which is a schematic plan view showing an example in which a lighting device is provided in the lower-yoke iron core assembling tank.

A sixteenth embodiment of the U-shaped iron core transporting/assembling method according to the present invention will be described with reference to FIG. 31. FIG. 31 shows the U-shaped iron core transporting/assembling tank 50 used in the present embodiment, which is a schematic plan view showing an example in which a lighting device 44 is provided in the lower-yoke iron core assembling tank 20. The same reference numerals are given to the same or corresponding parts, and the description will not be repeated.

In the present embodiment, a lighting device 44, etc. is provided in the lower-yoke iron core assembling tank 20. With this configuration, workability can be improved. Power supply to the lighting device 44 can be made in the same manner as in the case of the abovementioned dehumidifier 31 or dust collector 41.

Seventeenth Embodiment

Figure 32:
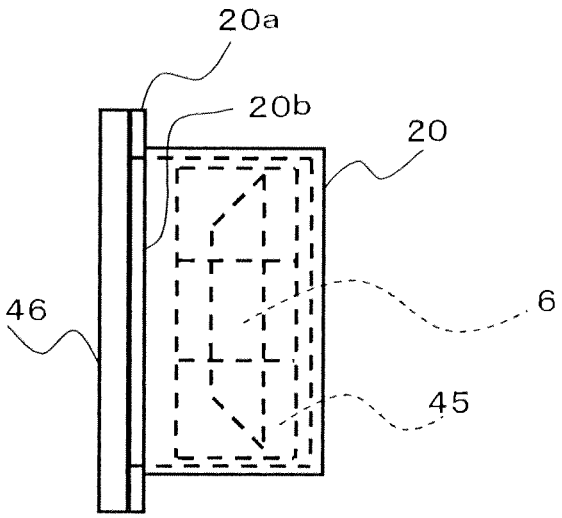
FIG. 32 shows a seventeenth embodiment of the U-shaped iron core transporting/assembling method according to the present invention, which is a schematic plan view showing an example in which the lower-yoke iron core assembling tank is used as a transporting tank.
Figure 33:
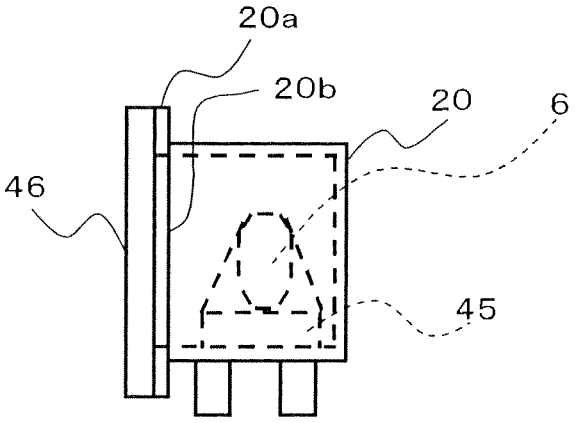
FIG. 33 is a schematic front view of the lower-yoke iron core assembling tank of FIG. 32.

A seventeenth embodiment of the U-shaped iron core transporting/assembling method according to the present invention will be described with reference to FIGS. 32 and 33. FIG. 32 shows the lower-yoke iron core assembling tank 20 used in the present embodiment, which is a schematic plan view showing an example in which the lower-yoke iron core assembling tank 20 is used as a transporting tank. FIG. 33 is a schematic front view of FIG. 32. The same reference numerals are given to the same or corresponding parts, and the description will not be repeated.

In the present embodiment, a fixing seat 45 for fixing the lower-yoke iron core 6 is provided in the lower-yoke iron core assembling tank 20 so as to allow the lower-yoke iron core assembling tank 20 to be used for transportation. More specifically, the fixing seat 45 is provided in the lower-yoke iron core assembling tank 20, and a transportation lid 46 is fitted to the third opening portion 20*a*, whereby the lower-yoke iron core assembling tank 20 can be used as a transportation tank.

For example, when the lower-yoke iron core 6 is carried in the lower-yoke iron core assembling tank 20 in a factory, the lower-yoke iron core 6 is disposed such that the longitudinal direction thereof is fixed horizontally. The lower-yoke iron core 6 is transported to the installation site of a transformer, etc. in this state. After that, as in the case of the abovementioned embodiments, the lower-yoke iron core assembling tank 20 and erection tank 10 are arranged such that the erection tank opening portion 10*b* and third opening portion 20*a* are opposed to each other, and the U-shaped iron core 51 is assembled by the abovementioned process.

Thus, in the present embodiment, in addition to the effects obtained by the above embodiments, it is possible to eliminate the process of carrying out the lower-yoke iron core 6 from the lower-yoke iron core transporting tank and carrying it in the lower-yoke iron core assembling tank 20, thereby further reducing the installation period.

Other Embodiments

The embodiments described above are merely given as examples, and it should be understood that the present invention cited in claims is not limited thereto. Further, the configurations of respective components of the present invention are not limited to the above embodiments but may be variously changed within the technical scope of the claims.

For example, the dehumidifier 31 shown in the eleventh embodiment, air vent 36 shown in the twelfth embodiment, dust collector 41 shown in the thirteenth embodiment, and lighting device 44 shown in the sixteenth embodiment may be provided in the lower-yoke iron core assembling tank 20 showing in the seventeenth embodiment which is used also for transporting the lower-yoke iron core 6.

What is claimed is:

1. A U-shaped iron core transporting/assembling tank which can be divided into at least a first leg iron core tank for housing a first leg iron core and transporting the first leg iron core to an installation site, a second leg iron core tank for housing a second leg iron core and transporting the second leg iron core to the installation site, and a lower-yoke iron core assembling tank, wherein the first leg iron core tank comprises:

a first longitudinal opening portion for opening or closing formed in one longitudinal side surface; and a first short opening portion for opening or closing formed in an end surface perpendicular to the one longitudinal side surface, the second leg iron core tank comprises:

a second longitudinal opening portion for opening or closing formed in one longitudinal side surface;

a second short opening portion for opening or closing formed in the end surface perpendicular to the side surface in which the second longitudinal opening portion is formed; and erection tank connecting means for connecting the second longitudinal opening portion which is opened in a state where the second leg iron core is housed in the Second leg iron core tank and the first longitudinal opening portion which is opened in a state where the first leg iron core is housed in the first leg iron core tank for integration of the first leg iron core tank and the second leg iron core tank so as to constitute an erection tank such that the first short opening portion and the second short opening portion are arranged in a single plane so as to become one opening portion to which a bottom plate can be fitted, and the lower-yoke iron core assembling tank comprises:

a third opening portion for opening or closing which is formed in one longitudinal side surface of the lower-yoke iron core and through which the lower-yoke iron core can be carried in or out; and lower-yoke iron core assembling tank connecting means for connecting the third opening portion which is opened in a state where the lower-yoke iron core is housed in the lower-yoke iron core assembling tank and opened the first short opening portion and opened the second short opening portion of the erection tank housing the first leg iron core and the second leg iron core for integration of the erection tank and the lower-yoke iron core assembling tank.

2. The U-shaped iron core transporting/assembling tank according to claim 1, wherein the lower-yoke iron core assembling tank comprises an upper surface opening portion which is formed in at least one side surface thereof other than a side surface in which the third opening portion is formed, which is configured to be capable of receiving the lower-yoke iron core and required materials after being connected to the erection tank, which is openable and closable, and which is capable of keeping inside airtight in a closed state by a closing lid.

3. U-shaped iron core transporting/assembling tank according to claim 1, wherein the lower-yoke iron core assembling tank has a fixing seat for fixing the lower-yoke iron core and is capable of being used as a tank for transporting the lower-yoke iron core.

4. The U-shaped iron core transporting/assembling tank according to claim 1, wherein the erection tank further comprises:

a lower-yoke fixing hardware for fixing the lower-yoke iron core thereinside, which can be divided at least at its center portion; and a lower-yoke fixing hardware connection seat for connecting parts obtained after the lower-yoke fixing hardware is divided.

5. The U-shaped iron core transporting/assembling tank according to claim 1, wherein the erection tank further comprises:

an upper portion U-shaped iron core hoisting support for connecting leading end portions of the first leg iron core and the second leg iron core, which can be divided at least at its central portion; and an upper portion U-shaped iron core hoisting support connection seat for connecting parts obtained after the upper portion U-shaped iron core hoisting support is divided.

6. The U-shaped iron core transporting/assembling tank according to claim 1, wherein an opening portion gasket is provided between the opening portions including at least at the first longitudinal opening portion, the second longitudinal opening portion, the first short opening portion, and the second short opening portion formed in the first leg iron core tank and the second leg iron core tank and lids for closing the opening portions.

7. The U-shaped iron core transporting/assembling tank according to claim 6, wherein spacer plates are provided at the portion at which the gasket is provided, including the first longitudinal opening portion, the second longitudinal opening portion, the first short opening portion, and the second short opening portion.

8. The U-shaped iron core transporting/assembling tank according to claim 1, wherein a connection portion gasket is provided at least between the first longitudinal opening portion and the second longitudinal opening portion and between the first and second short opening portions and the bottom plate.

9. The U-shaped iron core transporting/assembling tank according to claim 1, wherein pin insertion holes through which position fixing pins are inserted are formed at the opening portions of the erection tank, and, when the first leg iron core and the second leg iron core are connected to each other, the positions thereof are fixed by using the position fixing pins.

10. The U-shaped iron core transporting/assembling tank according to claim 1, wherein the first leg iron core tank and the second leg iron core tank are connected by a connection wire and, when the first leg iron core tank and the second leg iron core tank are connected to each other, the first leg iron core tank and the second leg iron core tank are moved by the connection wire.

* * * * *